US012778366B2

(12) United States Patent
Li et al.

(10) Patent No.: US 12,778,366 B2
(45) Date of Patent: Nov. 3, 2026

(54) CLEANING BRUSH AND INTELLIGENT CLEANING DEVICE HAVING THE SAME

(71) Applicant: Beijing Roborock Technology Co., Ltd., Beijing (CN)

(72) Inventors: Xing Li, Beijing (CN); Yongfei Zhou, Beijing (CN); Chuanlin Duan, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 919 days.

(21) Appl. No.: 18/068,969

(22) Filed: Dec. 20, 2022

(65) Prior Publication Data

US 2023/0277022 A1 Sep. 7, 2023

(30) Foreign Application Priority Data

Oct. 20, 2021 (CN) ..... 202111221003.4
Jan. 10, 2022 (CN) ..... 202210022939.2

(51) Int. Cl.
*A47L 9/04* (2006.01)

(52) U.S. Cl.
CPC ..... *A47L 9/0466* (2013.01); *A47L 9/0405* (2013.01); *A47L 2201/00* (2013.01)

(58) Field of Classification Search
CPC . A47L 9/00; A47L 9/04; A47L 9/0461; A47L 9/0466; A47L 9/0405;
(Continued)

(56) References Cited

U.S. PATENT DOCUMENTS 6,018,845 A 2/2000 Sueki et al.
2011/0252594 A1 10/2011 Blouin
(Continued)

FOREIGN PATENT DOCUMENTS

CN 103957766 A 7/2014
CN 203809169 U 9/2014
(Continued)

OTHER PUBLICATIONS

Office action from Chinese Application No. 202210022939.2 dated Jan. 28, 2023.
(Continued)

*Primary Examiner* — C. A. Rivera
(74) *Attorney, Agent, or Firm* — Calfee, Halter & Griswold LLP

(57) ABSTRACT

The present disclosure provides a cleaning brush and an intelligent cleaning device. The cleaning brush includes a shaft rod, a cylindrical member and at least one end member. The shaft rod is provided with two first ends which are opposite in an axial direction; the cylindrical member coaxially sleeves the shaft rod and is provided with two second ends which are opposite in an axial direction, and a brush piece is arranged on an outer surface of the cylindrical member; the at least one end member is installed on at least one of the first ends, and the end member is provided with a blocking structure for preventing an entanglement from excessively extending away from the cleaning brush; the end member and the first end are provided with installation structures respectively matching each other; and the second end of the cylindrical member, which corresponds to the end member, covers at least a portion of the end member.

16 Claims, 9 Drawing Sheets

(58) Field of Classification Search
CPC .... A47L 9/0433; A47L 9/0455; A47L 9/0477; A47L 2201/00
See application file for complete search history.

(56) References Cited

U.S. PATENT DOCUMENTS

| | | | | |
|---|---|---|---|---|
| 2016/0345792 | A1 | 12/2016 | Herron et al. | |
| 2021/0052119 | A1* | 2/2021 | Choi | A47L 9/0477 |

FOREIGN PATENT DOCUMENTS

| | | | |
|---|---|---|---|
| CN | 105361809 | A | 3/2016 |
| CN | 205514379 | U | 8/2016 |
| CN | 105982625 | A | 10/2016 |
| CN | 207356040 | U | 5/2018 |
| CN | 108403000 | A | 8/2018 |
| CN | 108742313 | A | 11/2018 |
| CN | 108903799 | A | 11/2018 |
| CN | 110338702 | A | 10/2019 |
| CN | 210493948 | U | 5/2020 |
| CN | 212089421 | U | 12/2020 |
| CN | 112515551 | A | 3/2021 |
| CN | 112587037 | A | 4/2021 |
| CN | 112932364 | A | 6/2021 |
| CN | 113876270 | A | 1/2022 |
| CN | 113876271 | A | 1/2022 |
| CN | 114247670 | A | 3/2022 |
| CN | 217338427 | U | 9/2022 |
| CN | 217411582 | U | 9/2022 |
| EP | 3563743 | A1 | 11/2019 |
| EP | 4464222 | A1 | 11/2024 |
| JP | H04361724 | A | 12/1992 |
| JP | H05317226 | A | 12/1993 |
| JP | H0630863 | A | 2/1994 |
| JP | H08509 | A | 1/1996 |
| JP | H0947394 | A | 2/1997 |
| JP | H1156707 | A | 3/1999 |
| JP | 2003080922 | A | 3/2003 |
| JP | 2004216137 | A | 8/2004 |
| JP | 2007128113 | A | 5/2007 |
| JP | 2009534142 | A | 9/2009 |
| JP | 2015517899 | A | 6/2015 |
| JP | 2016013262 | A | 1/2016 |
| JP | 2019159217 | A | 9/2019 |
| JP | 2021050748 | A | 4/2021 |
| JP | 2021122786 | A | 8/2021 |
| JP | 2021145943 | A | 9/2021 |
| KR | 1020150116133 | A | 10/2015 |
| WO | 2021082845 | A1 | 5/2021 |

OTHER PUBLICATIONS

Xin Zheng et al., Article "Mall service technology and specifications", dated Jul. 31, 2001.
Office action from Chinese Application No. 202111221003.4 dated Dec. 16, 2022.
First Office Action of JP application No. 2024-541761 dated Sep. 16, 2025.
First Office Action of CN application No. 2023107993156 dated Sep. 18, 2025.
Extended European Search Report of EP application No. 22918176.3 dated Nov. 14, 2025.
Search Report from PCT/CN2022/110958 dated Nov. 2, 2022.
Office Action from Chinese Application No. 202210022939.2 dated Aug. 17, 2022.
Office Action from Chinese Application No. 202111221003.4 dated May 18, 2022.
Office action from Chinese Application No. 202111221003.4 dated May 31, 2023.
Notice of Allowance of JP application No. 2024-541761 dated Mar. 24, 2026.
Notice of Allowance of CN application No. 2023107993156 dated Mar. 30, 2026.

* cited by examiner

4001

C

CLEANING BRUSH AND INTELLIGENT CLEANING DEVICE HAVING THE SAME

CROSS-REFERENCE TO RELATED APPLICATION

The present disclosure claims priorities to Chinese Patent Application No. 202111221003.4 filed on Oct. 20, 2021, and Chinese Patent. Application No. 202210022939.2 filed on Jan. 10, 2022, which are hereby cited in their entireties as a part of this application.

TECHNICAL FIELD

The present disclosure relates to the field of cleaning device technologies, and particularly, to a cleaning brush and an intelligent cleaning device.

BACKGROUND

A cleaning brush is an important functional part of a cleaning device. An end cover of the cleaning brush is used to block an entanglement such as hairs or silk threads wound during a working process of the cleaning device, so as to avoid the phenomenon of jamming of a power output end and a bearing end of a motor due to entanglement because of excessive extension of the entanglement to the end of the cleaning brush.

As an intelligent household appliance, a sweeping robot plays an increasingly important rote in people's daily lives. The sweeping robot generally includes a dust suction system, a walking system and a power supply system. The dust suction system is used to collect dust on the ground, the walking system is used to drive the sweeping robot to move, and the power supply system is used to supply energy to the dust suction system and the walking system to work. An end cover of the existing cleaning brush has a relatively small size, such that a longer end of a shaft rod of the cleaning brush is exposed outside the end cover; and the end cover is located outside a cylindrical member sleeving a shaft cover of the cleaning brush. Consequently, it is easy for an entanglement wound around the cylindrical member to wind from the end of the cylindrical member to the end of the shaft rod, resulting in a relatively deep entangling position. In addition, the end cover must be detached to remove the entanglement from the inside of the cylinder member, which is laborious. In addition, due to the relatively small size of the end cover of the existing cleaning brush, it is difficult to find the missing installation of the end cover of the cleaning brush in the assembly process, so it is necessary to provide a responsible missing-installation prevention structure.

SUMMARY

The present disclosure adopts the following technical solutions.

According to an aspect of the present disclosure, a cleaning brush is provided. The cleaning brush includes a shaft rod, a cylindrical member and at least one end member, wherein the shaft rod is provided with two first ends opposite in an axial direction; the cylindrical member coaxially sleeves the shaft rod and is provided with two second ends opposite in an axial direction, and a brush piece is arranged on an outer surface of the cylindrical member; the at least one end member is installed on at least one of the first ends, and the end member is provided with a blocking structure used for preventing an entanglement from excessively extending away from the cleaning brush; the end member and the first end are provided with installation structures matching each other respectively; and the second end of the cylindrical member, which corresponds to the end member, covers at least a portion of the end member.

According to another aspect of the present disclosure, an intelligent cleaning device is provided. The intelligent cleaning device includes a cleaning brush, wherein the cleaning brush includes a shall rod, a cylindrical member and at least one end member, wherein the shaft rod is provided with two first ends opposite in an axial direction; the cylindrical member coaxially sleeves the shaft rod and is provided with two second ends opposite in an axial direction, and a brush piece is arranged on an outer surface of the cylindrical member; the at least one end member is installed on at least one of the first ends, and the end member is provided with a blocking structure used for preventing an entanglement from excessively extending away from the cleaning brush; the end member and the first end are provided with installation structures matching each other respectively; and the second end of the cylindrical member, which corresponds to the end member, covers at least a portion of the end member.

BRIEF DESCRIPTION OF THE DRAWINGS

Various objects, features, and advantages of the present disclosure will become more apparent by considering the following detailed description of embodiments of the present disclosure in conjunction with the accompanying drawings. The accompanying drawings are merely exemplary illustrations of the present disclosure, and are not necessarily drawn to scale. In the accompanying drawings, the same reference numerals always refer to the same or similar components, in which.

Figure 1:
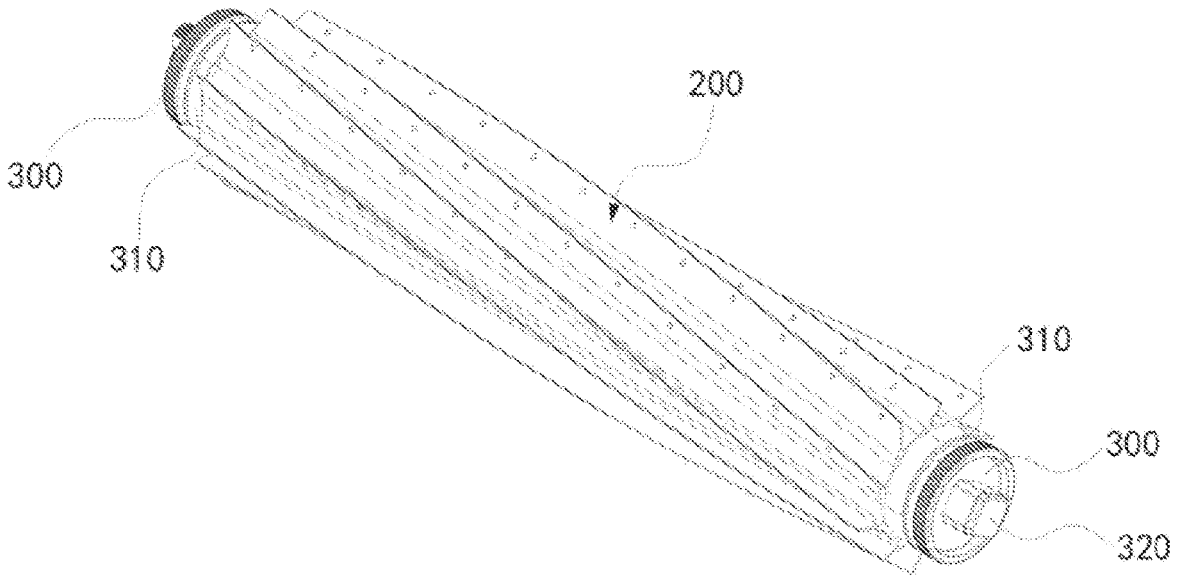
FIG. 1 is a schematic diagram of a three-dimensional structure of a cleaning brush shown according to an exemplary embodiment.

Reference numerals represent the following components:

100: shaft rod;
110: first end;
200: cylindrical member;
210: second end;
300: end member;
310: blocking structure;
320: transmission structure;
330: friction structure;
400: installation structure;
411: guide hole;
412: guide shaft;
4121: matching section;
4122: positioning groove;
420: guide sleeve;
421: first assembly identifier;
422: second assembly identifier;
431: limiting groove;
432: limiting rib;
500: bearing structure;
A: coverage area;
L0: length;
L1: distance;
1001: main brush body;
1101: clearance groove;
1201: through hole;
1301: sleeve;
1401: gap;
2001: blade;
2011: first blade;
2021: second blade;
2101: cleaning surface;
2201: salient point;
3001: wool strip;
3101: bristles;
4001: main brush shaft;
4101: main shaft;
4111: insertion groove;
4121: clamping groove;
4201: end cover;
4211: barrel body;
42111: installing groove;
42121: protrusion;
4221: connecting shaft;
4301: bearing; and
4311: bearing sleeve.

DETAILED DESCRIPTION

Typical embodiments embodying the features and advantages of the present disclosure will be described in detail in the following description. It should be understood that the present disclosure can have various variations in different embodiments, none of which departs from the scope of the present disclosure; and the descriptions and drawings therein are essentially for illustrative purposes and not intended to limit the present disclosure.

The following description of different exemplary embodiments of the present disclosure is given with reference to the accompanying drawings. The accompanying drawings form a part of the present disclosure, and different exemplary structures, systems and steps that may implement a plurality of aspects of the present disclosure are shown in examples. It should be understood that other specific schemes of components, structures, exemplary apparatuses, systems and steps may be used, and structural and functional modifications may be made without departing from the scope of the present disclosure. Further, although the terms "above", "between", "within" and the like may be used in the present description to describe different exemplary features and components of the present disclosure, but these terms are used herein only for convenience, for example, according to orientations in examples described in the accompanying drawings. Nothing in the present description should be construed to mean that a particular three-dimensional orientation of the structure is required to fall within the scope of the present disclosure.

It should be noted that, unless otherwise specified, when a feature is referred to be "fixed" or "connected" to another feature, it may be directly fixed and connected to another feature, or indirectly fixed and connected to another feature. Further, the descriptions of "upper", "lower", "left", "tight", "top", "bottom", etc, as used in the present disclosure are given only relative to a position relationship of the components of the present disclosure in the accompanying drawings.

Further, unless otherwise defined, all technical and scientific terms used herein have the same meaning as commonly understood by a person of ordinary skill in the art. The terms used in the description of the present disclosure are only for the purpose of describing specific embodiments, and are not intended to limit the present disclosure. The term "and/or" as used herein includes any combinations of one or more related listed items.

It should be understood that although the terms "first", "second", "third", etc. may be used in the present disclosure to describe various components, these components should not be limited to these terms. These terms are only used to distinguish components of the same type from each other. For example, without departing from the scope of the present disclosure, the first component may also be referred to as a second component, and similarly, the second component may also be referred to as a first component.

Referring to FIG. 1, a schematic diagram of a three-dimensional structure of a cleaning brush proposed in the present disclosure is representatively shown. In this exemplary implementation, the cleaning brush proposed in the present disclosure is illustrated by taking an example of being applied to an intelligent cleaning robot. As easily understood by a person skilled in the art, in order to apply relevant designs of the present disclosure to other types of cleaning devices, various modifications, additions, replacements, deletions or other changes are made to the following specific implementations, but these changes still fall within the scope of the principles of the cleaning brush proposed in the present disclosure.

Figure 3:
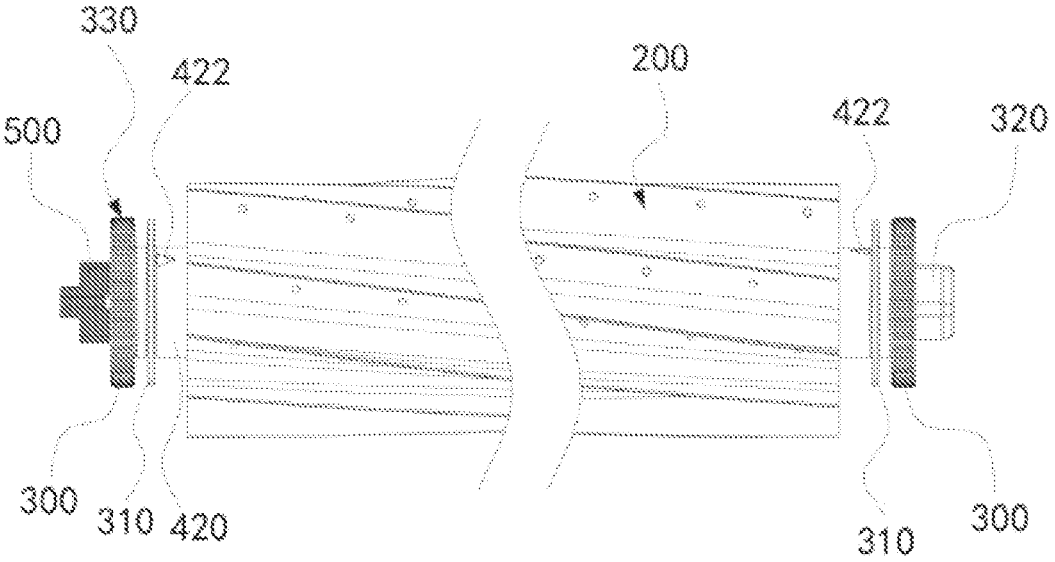
FIG. 3 is a front view of FIG. 1.
Figure 4:
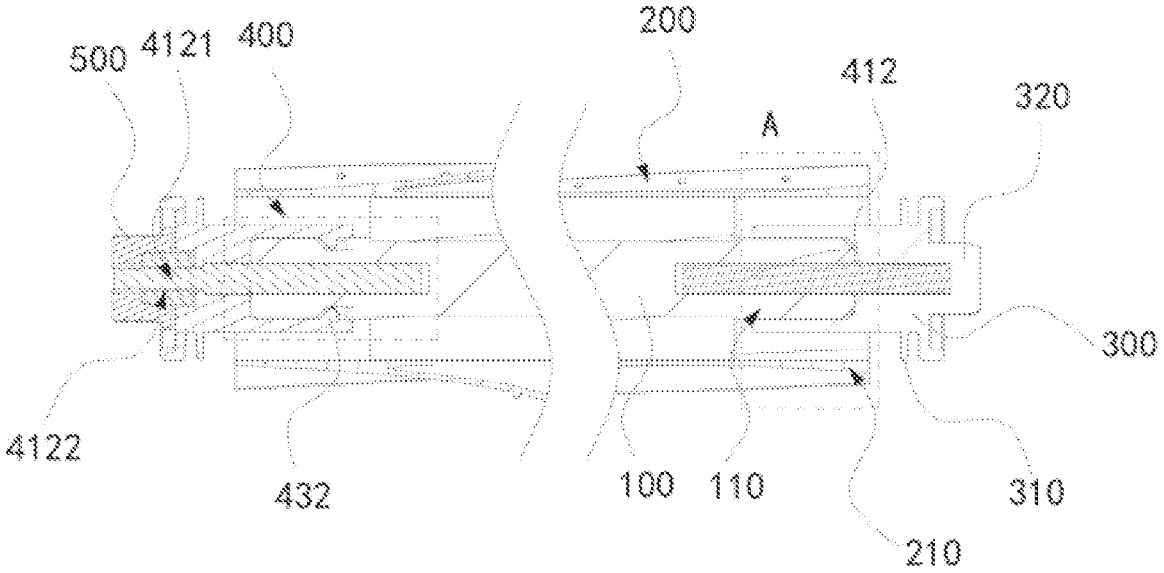
FIG. 4 is a sectional view of a shaft side of FIG. 3.
Figure 5:
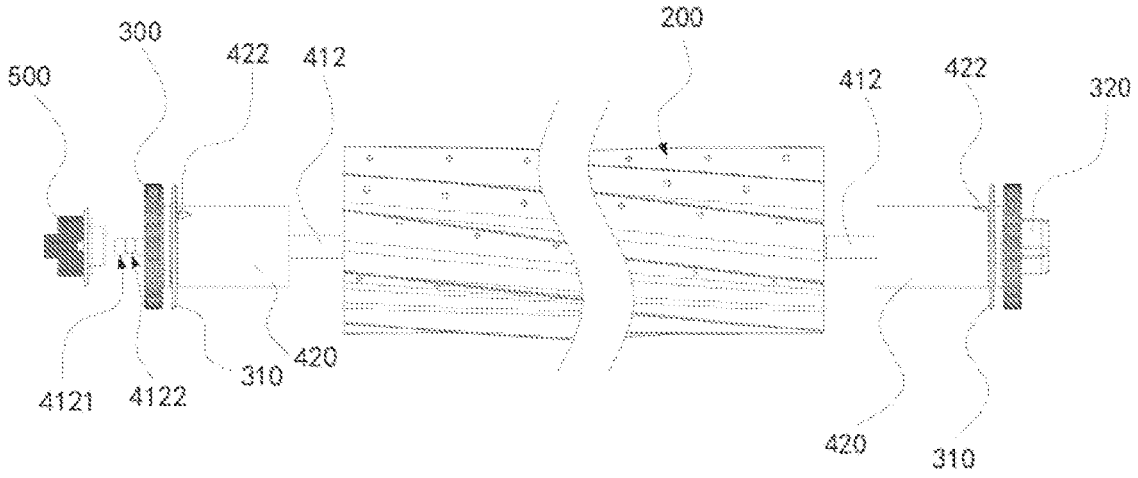
FIG. 5 is a front view of FIG. 2.
Figure 6:
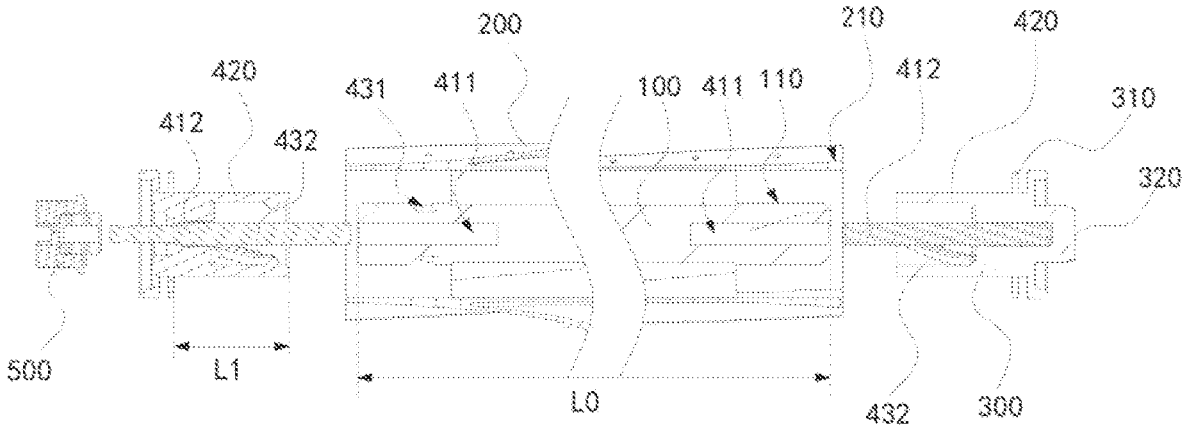
FIG. 6 is a sectional view of a shaft side of FIG. 5.
Figure 7:
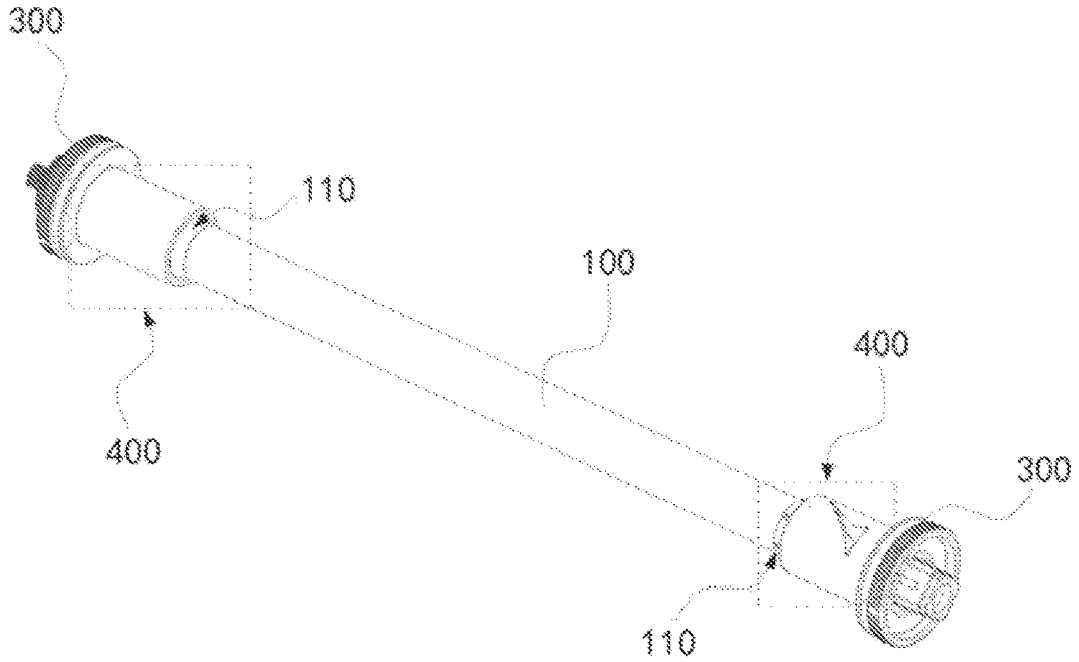
FIG. 7 is a schematic diagram of a three-dimensional structure of a shaft rod and an end member of the cleaning brush shown in FIG. 1.
Figure 8:
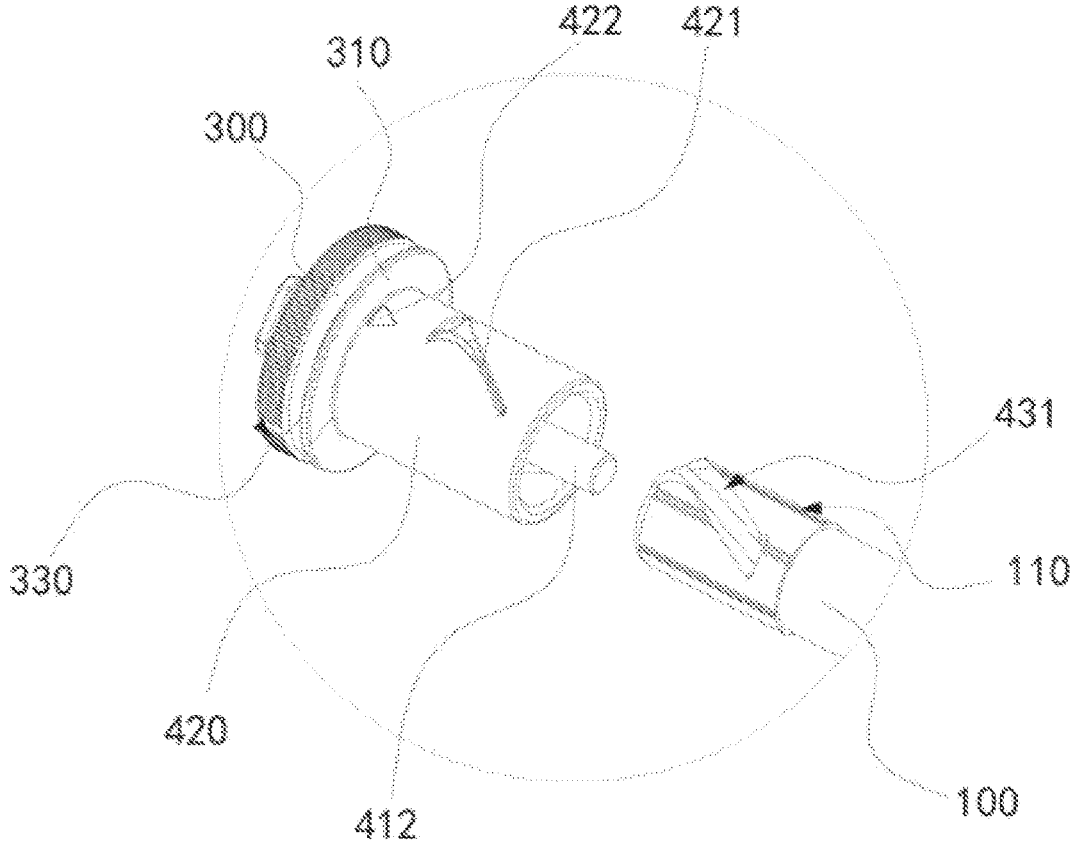
FIG. 8 is an enlarged schematic diagram of an exploded state of part of the structure shown in FIG. 7.

As shown in FIG. 1, in this implementation, the cleaning brush proposed in the present disclosure mainly includes a shaft rod 100 (not shown in the figure), a cylindrical member 200 and two end members 300. Referring to FIGS. 2 to 8, FIG. 2 representatively shows a schematic three-dimensional exploded view of the cleaning brush; FIG. 3 representatively shows a front view of FIG. 1; FIG. 4 representatively shows a sectional view of a shaft side of FIG. 3; FIG. 5 representatively shows a front view of FIG. 2; FIG. 6 representatively shows a sectional view of a shaft side of FIG. 5; FIG. 7 representatively shows a schematic diagram of a three-dimensional structure of the shaft rod 100 and the end members 300; and FIG. 8 representatively shows an enlarged schematic diagram of an exploded state of part of the structure shown in FIG. 7, and specifically shows an exploded state of one end member 300 and one first end 110 of the shaft rod. The structures, connection modes and functional relationships of main components of the cleaning brush proposed in the present disclosure will be described in detail below in conjunction with the above accompanying drawings.

As shown in FIGS. 1 to 4, in one implementation of the present disclosure, the shaft rod 100 has two first ends 110 opposite in an axial direction, that is, two ends of the shaft rod 100 are the first ends 110 respectively. The cylindrical member 200 coaxially sleeves the shaft rod 100 and is provided with two second ends 210 opposite in an axial direction, that is, two ends of the cylindrical member 200 are second ends 210 respectively. A brush piece is arranged on an outer surface of the cylindrical member 200. The two end members 300 are installed on the two first ends 110 of the shaft rod 100 respectively. Each end member 300 is provided with a blocking structure 310 capable of preventing an entanglement such as hairs and silk threads from excessively extending away from the cleaning brush. In addition, the end member 300 and the first end 110 corresponding to the end member 300 are provided with installation structures 400 matching each other respectively. On this basis, the second end 210 of the cylindrical member 200, which corresponds to the end member 300, covers at least a portion of the end member 300, see a coverage area A shown in FIG. 4 for details. With the above design, in the present disclosure, at least part of the end member 300 intervenes between the shaft rod 110 and the corresponding end of the cylindrical member 200, avoiding an entanglement wound on the cylindrical member 200 from being wound to the shaft rod 100. Instead, the entanglement is wound on the end members 300 and can thus be removed with the disassembly of the end members 300, such that cleaning is more convenient. In addition, during the assembly process of the cleaning brush, it is easier to find that the cleaning brush is provided with no end member 300 if the end member 300 is not assembled.

It should be noted that each implementation of the present description is illustrated by taking the two first ends 110 of the shaft rod 100 being provided with the end members 300 respectively as an example. It should be understood that in some implementations, it is also possible to install an end member 300 only on one first end 110 of the shaft rod 100 in the present disclosure. In other words, in various possible implementations conforming to the design conception of the present disclosure, the cleaning brush proposed in the present disclosure includes at least one end member 300, the at least one end member 300 being installed on at least one first end 110 of the shall rod 100.

Figure 2:
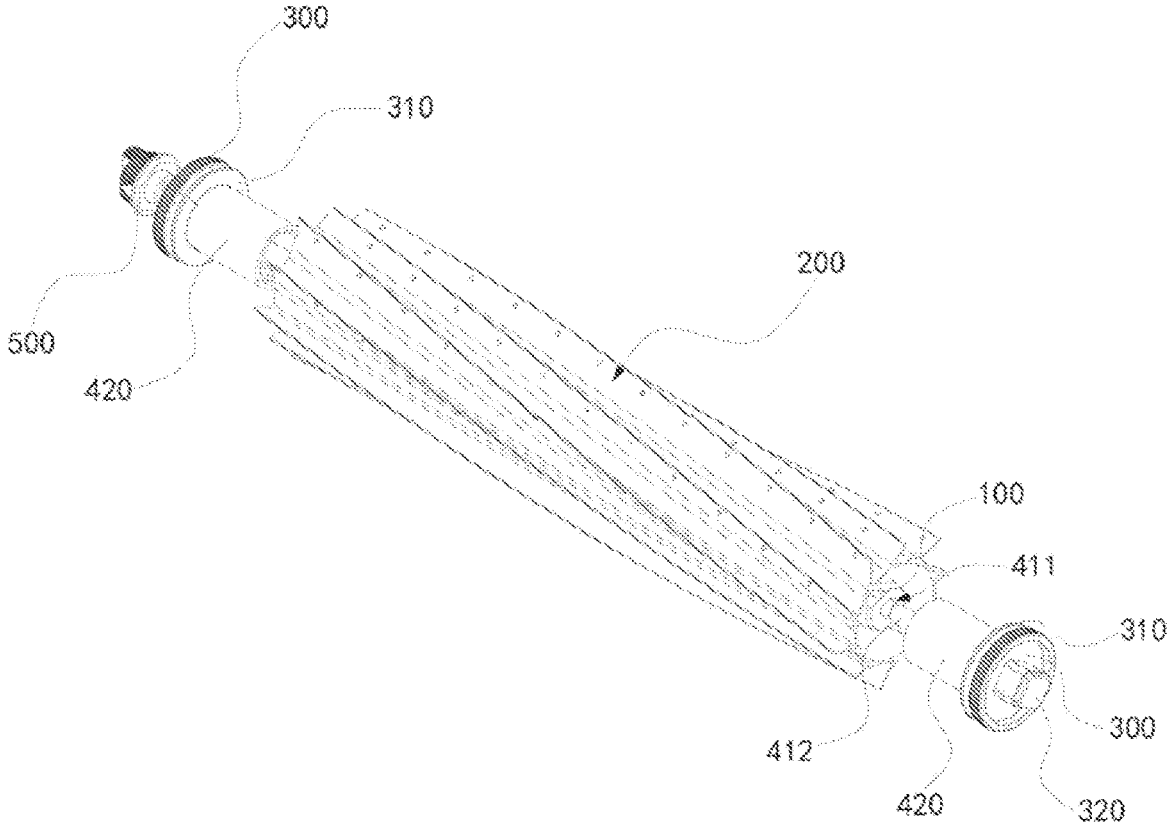
FIG. 2 is a schematic three-dimensional exploded view of the cleaning brush shown in FIG. 1.

As shown in FIGS. 2, 4 and 6, in one implementation of the present disclosure, the second end 210 of the cylindrical member 200, which corresponds to the end member 300, may cover the first end 110, on which the end member 300 is installed. In other words, the first end 110 on which the end member 300 is installed is all located within a coverage range of the second end 210 corresponding to the first end, that is, the first end 110 does not extend out of the second end 210, and also the length of the shaft rod 100 is less than the length of the cylindrical member 200. In sonic implementations, the first end 110 on which the end member 300 is installed may also partially extend out of the coverage range of the corresponding second end 210, that is, the first end 110 may extend out of the coverage area A shown in FIG. 4, but is not limited thereto in this implementation, as long as it is ensured that the second end 210 covers at least part of the end member 300.

As shown in FIGS. 1 to 6, in one implementation of the present disclosure, the blocking structure 310 of the end member 300 may be located outside the second end 210 of the cylindrical member 200, which corresponds to the end member 300. In other words, the blocking structure 310 of the end member 300 may be located outside the coverage area A shown in FIG. 4.

As shown in FIGS. 2, FIG. 4 and FIG. 6, in one implementation of the present disclosure, the installation structure 400 may include a guide hole 411 and a guide shaft 412. Specifically, the guide hole 411 is coaxially formed in an end surface of the first end 110). The guide shaft 412 is connected to the end member 300 and used for being inserted into the guide hole 411. With the above design, the guide shaft 412 and the guide hole 411 cooperate with each other by means of insertion, so that an axial guidance function and a radial limiting function are provided in the installation of the end members 300 and the shaft rod 100 in the present disclosure.

As shown in FIGS. 1 to 6, in one implementation of the present disclosure, the installation structure 400 may further include a guide sleeve 420. Specifically, the guide sleeve 420 is arranged at an end of the end member 300 facing the shaft rod 100 and can sleeve the first end 110. On this basis, a sidewall of the first end 110 is provided with a first limiting structure, and an inner wall of the guide sleeve 420 is provided with a second limiting structure matching the first limiting structure. Accordingly, the cleaning brush can achieve no relative rotation between the shaft rod 100 and the end members 300 by means of the cooperation between the first limiting structure and the second limiting structure.

In addition, as shown in FIGS. 2, FIG. 4 and FIG. 6, in one implementation of the present disclosure, the installation structure 400 may include a guide hole 411, a guide shall 412 and a guide sleeve 420 at the same time. On this basis, the guide sleeve 420 may be arranged around the periphery of at least part of sections of the guide shaft 412 at intervals. In some implementations, the installation structure 400 may also include a guide hole 411 and a guide shaft 412 only, or a guide sleeve 420 alone, or realize installation and fixation of the end member 300 and the first end 110 of the shaft rod 100 by means of other structures.

As shown in FIG. 6, in one implementation of the present disclosure, along the axial direction of the shaft rod 100, the distance L1 between the blocking structure 310 corresponding to the same first end 110 and an end of the guide sleeve 420 away from the end member 300 may account for more than 5%, e.g., 5%, 8%, 10% or 15% of the length L0 of the shaft rod 100. Accordingly, compared with the existing cleaning brush in which an end cover has a relatively small size, the cleaning brush of the present disclosure is characterized in that through the design that the guide sleeve 420 partially intervenes between the first end 110 and the second end 210, each end member 300 has a relatively large size (including a size of the guide sleeve 420), so as to increase a space of the end member 300 for an entanglement to wind, and further prevent the entanglement from being wound to the shaft rod 100. In other words, according to the present disclosure, the design of a length relationship of the above related members is adopted, so that the length of a part of each end member 300 which matches the shaft rod 100 is extended, resulting in a size increase and easy processing and production.

As shown in FIGS. 6 and 8, in one implementation of the present disclosure, the first limiting structure may be a limiting groove 431, the second limiting structure may be a limiting rib 432, and the limiting groove 431 matches the limiting rib 432 in shape. Accordingly, in the process of the guide sleeve 420 sleeving the first end 110 of the shaft rod 100, the limiting rib 432 and the limiting groove 431 cooperate with each other to provide guiding and limiting functions during the above installation process. In some implementations, the first limiting structure may also be a limiting rib 432, and the second limiting structure may also be a limiting groove 431. In other words, in various possible implementations conforming to the design conception of the present disclosure, one of the first limiting structure and the second limiting structure may be a limiting rib 432, and the other may be a limiting groove 431 whose shape matches that of the limiting rib 432. In addition, the first limiting structure and the second limiting structure can also adopt other forms of limiting cooperation structures, but are not limited to this.

As shown in FIG. 6 and FIG. 8, in one implementation of the present disclosure, the limiting rib 432 and the limiting groove 431 are in spiral shapes which match each other. Accordingly, in the disassembly and assembly processes of the end members 300 and the shaft rod 100, a relative displacement in an axial direction and a relative rotation in a circumferential direction exist therebetween.

Based on the design of the spiral shape of the limiting rib 432 and the limiting groove 431, in one implementation of the present disclosure, a spiral direction of the spiral limiting rib 432 and the spiral limiting groove 431 may be opposite to a rotation direction of the shaft rod 100. With the above design, in a case that the shaft rod 100 rotates in the cleaning device in a rotation direction, the limiting rib 432 can be further prevented from being disengaged from the limiting groove 431 as the spiral direction of the limiting rib 432 and the limiting groove 431 is opposite to this rotation direction, thereby ensuring the installation stability and reliability of the shaft rod 100 and the end members 300.

As shown in FIG. 7 and FIG. 8, based on the design of the spiral design of the limiting rib 432 and the limiting groove 431, in one implementation of the present disclosure, an outer wall of the guide sleeve 420 may be provided with at least one first assembly identifier 421 which can mark a rotation direction (i.e., the spiral direction of the limiting rib 432 and the limiting groove 431) when the end members 300 and the shaft rod 100 are assembled.

As shown in FIG. 7 and FIG. 8, based on the design that the guide sleeve 420 is provided with the first assembly identifier 421, in one implementation of the present disclosure, the outer wall of the guide sleeve 420 may be provided with a deformation groove, which can prevent a shrinkage deformation of injection molded parts such as the guide sleeve 420 and the end members 300. On this basis, the deformation groove may adopt a special shape, e.g., approximately a triangle, an arrow, etc., as the first assembly identifier 421 to mark the rotation direction when the end members 300 and the shaft rod 100 are assembled while preventing the shrinkage deformation.

As shown in FIG. 4 and FIG. 6, in one implementation of the present disclosure, the limiting rib 432 may be arranged on an inner wall of the guide sleeve 420 through an integrated molding process in a case that the second limiting structure is the limiting rib 432. In one implementation, the limiting rib 432 may also be arranged on the inner wall of the guide sleeve 420 through other processes, e.g., by welding, or formed from part of the structure of the guide sleeve 420 by stamping, etc. Moreover, a limiting groove 431 may be a groove formed in the inner wall of the guide sleeve 420 or a through groove penetrating through the guide sleeve 420, in a case that the second limiting structure is the limiting groove 431.

In one implementation of the present disclosure, the first end 110 may be provided with a plurality of first limiting structures, which is uniformly arranged at intervals in a circumferential direction of the shaft rod 100.

In one implementation of the present disclosure, the guide sleeve 420 may be provided with a plurality of the second limiting structures, which is uniformly arranged at intervals in a circumferential direction of the guide sleeve 420.

As described above, by taking the first limiting structure and the second limiting structure being the limiting groove 431 and the limiting rib respectively as an example, in a case of a plurality of limiting grooves 431, the number of the limiting rib 432 may be one or more, and the number of the limiting ribs 432 is not greater than the number of the limiting grooves 431, but may be less than the number of the limiting grooves 431.

As shown in FIG. 5 and FIG. 8, in one implementation of the present disclosure, the outer wall of the guide sleeve 420 may be provided with at least one second assembly identifier 422, and the at least one second assembly identifier 422 may correspond to at least one second limiting structure in position and accordingly is capable of marking a position of the at least one second limiting structure. In some implementations, in a case that the inner wall of the guide sleeve 420 is provided with a plurality of second limiting structures, the outer wall of the guide sleeve 420 may be provided with only one second assembly identifier 422 which corresponds to any second limiting structure; or the outer wall of the guide sleeve 420 may be provided with a plurality of second assembly identifiers 422 which correspond to the plurality of second limiting structures respectively.

As shown in FIGS. 1 to 6, in one implementation of the present disclosure, the blocking structure 310 of each end member 300 may be a blocking ring which may surround the outer circumference of the end member 300 and is a closed-loop structure.

As shown in FIGS. 1 to 7, in one implementation of the present disclosure, the end member 300 is installed on each of the two first ends 110 of the shaft rod 100. On this basis, one of the two end members 300 is provided with a transmission structure 320, the transmission structure 320 being used to transmit a torque. The other of the two end members 300 is used for installation of a bearing structure 500. On this basis, the end member 300 provided with the transmission structure 320 is connected to a driving mechanism of the cleaning device through the transmission structure 320, and the end member 300 on which the bearing structure 500 is installed is rotatably connected to other structures (e.g., a device body) of the cleaning device through the bearing structure 500. Accordingly, in a case that the end member 300 (i.e., a driving side end cover) provided with the transmission structure 320 is installed, the driving side end cover rotates around the guide hole 411. In addition, due to the spiral limiting groove 431 and the spiral limiting rib 432, the driving side end cover may move in an axial direction while rotating, thereby completing the entire assembly and disassembly of the end cover. Similarly, in a case that the end member 300 (i.e., a bearing side end cover) for installation of the bearing structure 500 is installed, the bearing side end cover may also be assembled and disassembled according to the same movement logic. Meanwhile, since the spiral direction of the spiral limiting rib 432 and the spiral limiting groove 431 is opposite to the rotation direction of the shaft rod 100 (i.e., a working direction of a main brush), spiral loosening will not occur during work. With the above design, in the assembly process of the cleaning brush, cooperation structures (e.g., laminated structures and bearing structures 500) installed or provided on the two end members 300 respectively are not disposed in a case that the end members 300 are not assembled, such that main brush parts (e.g., the shaft rod 100 and the cylindrical member 200) cannot be installed in place after missing installation of the end members 300, thereby achieving a more thorough missing installation prevention function. In addition, in a case that the end members 300 are installed at, the two first ends 110 of the shall rod 100 respectively, he same installation structure 400 is adopted between the two first ends 110 of the shaft rod 100 and between the two end members 300, which is convenient for foolproof production, thereby being conducive to reducing a processing error rate and increasing a production yield.

As shown in FIG. 1 and FIG. 2, based on the design that one end member 300 is provided with the transmission structure 320, in one implementation of the present disclosure, the transmission structure 320 may include a columnar structure with a regularly polygonal cross-section, an axis of the columnar structure coinciding with an axis of the end member 300 and an axis of the shaft rod 100, the transmission structure being accordingly used to cooperate with an output end of a driving mechanism, e.g., a final-stage output gear of a gearbox.

As shown in FIGS. 2 to 6, based on the design that the bearing structure 500 is installed on the other end member 300, in one implementation of the present disclosure, an end of the guide shaft 412 arranged on the end member 300, which is away from the shaft rod 100, extends out of the end member 300 and serves as a matching section 4121 matching the bearing structure 500; and the bearing structure 500 is detachably arranged on the matching section 4121 of the guide shaft 412.

As shown in FIG. 5 and FIG. 6, based on the design that the guide shaft 412 is provided with the matching section 4121, in one implementation of the present disclosure, the matching section 4121 of the guide shaft 412 may be provided with a positioning groove 4122 in a circumferential direction. For example, the outer diameter of the matching section 4121 is designed to be smaller than the outer diameter of other section of the guide shaft 412, such that the matching section 4121 forms the positioning groove 4122. On this basis, the positioning groove 4122 cooperates with the bearing structure 500 by fixing each other's positions for preventing the bearing structure 500 from displacing.

As shown in FIG. 8, in one implementation of the present disclosure, a friction structure 300, for example, but not limited to friction lines or fraction bulges, may be arranged on the end member 300, such that it is easier to screw the end member 300 during assembly.

In one implementation of the present disclosure, the cylindrical member 200 may be a flexible member or a rigid member. In addition, the brush piece may be arranged on the outer surface of the cylindrical member 200 by means of sticking, insertion and the like. In a case that the cylindrical member 200 is the flexible member, the brush piece and the cylindrical member 200 may also be integrally formed. In some implementations, the brush piece may also be a blade, bristles or in other forms.

It should be noted herein that the cleaning brush shown in the drawings and described in the present description is only a few examples of many types of cleaning brushes capable of adopting the principles of the present disclosure. It should be clearly understood that the principles of the present disclosure are in no way limited to any detail or any part of the cleaning brush shown in the drawings or described in the present description.

For example:

in an implementation of the present disclosure, the first end is provided with a plurality of the first limiting structures, which is uniformly arranged at intervals in a circumferential direction of the shaft rod.

In an implementation of the present disclosure, the guide sleeve is provided with a plurality of the second limiting structures, which is uniformly arranged at intervals in a circumferential direction of the guide sleeve.

In an implementation of the present disclosure, the outer wall of the guide sleeve is provided with at least one second assembly identifier, the at least one second assembly identifier corresponding to the at least one second limiting structure in position and used for marking a position of the at least one second limiting structure.

In an implementation of the present disclosure, the blocking structure is a blocking ring, the blocking ring surrounding the outer circumference of the end member and being a closed-loop structure.

In an implementation of the present disclosure, the end member is installed on each of the two first ends of the shaft rod, one of the two end members is provided with a transmission structure, and the other is used for installation of a bearing structure.

In an implementation of the present disclosure, the transmission structure includes a columnar structure with a regularly polygonal cross-section, an axis of the columnar structure coinciding with an axis of the end member and an axis of the shaft rod; and the transmission structure is used to cooperate with an output end of a driving mechanism.

In an implementation of the present disclosure, one end of the guide shaft of one of the end members, which is away from the shaft rod, extends out of the end member and serves as a matching section matching the bearing structure; and the bearing structure is detachably arranged on the matching section of the guide shaft.

In an implementation of the present disclosure, the matching section is provided with a positioning groove in a circumferential direction, the positioning groove cooperating with the bearing structure by fixing each other's positions to prevent the bearing structure from displacing.

In an implementation of the present disclosure, the cylindrical member may be a flexible member or a rigid member.

Based on the above detailed description of several exemplary implementations of the cleaning brush proposed in the present disclosure, an exemplary implementation of the intelligent cleaning device proposed in the present disclosure will be described below.

In one implementation of the present disclosure, the intelligent cleaning device proposed in the present disclosure includes a cleaning brush proposed in the present disclosure and detailed in the above implementations.

It should be noted herein that the intelligent cleaning device shown in the drawings and described in the present description is only a few examples of many types of intelligent cleaning device capable of adopting the principles of the present disclosure. It should be clearly understood that the principles of the present disclosure are in no way limited to any detail or any part of the intelligent cleaning device shown in the drawings or described in the present description.

In summary, the cleaning brush purposed by the present disclosure includes the shaft rod 100, the cylindrical member 200 and the end members 300. Each end member 300 is installed on the first end 110 of the shaft rod 100. Each end member 300 is provided with the blocking structure 310 for preventing an entanglement from excessively extending away from the cleaning brush. The end member 300 and the first end 110 are provided with installation structures 400 matching each other respectively. The second end 210 of the cylindrical member 200, which corresponds to the end member 300, covers at least a portion of the end member 300. With the above design, in the present disclosure, at least part of the end member 300 intervenes between the shaft rod 100 and the corresponding end of the cylindrical member 200, avoiding an entanglement wound on the cylindrical member 200 from being wound to the shaft rod 100. Instead, the entanglement is wound on the end member 300 and can thus be removed with the disassembly of the end member 300, such that cleaning is more convenient.

Generally, a sweeping robot includes a housing, a cleaning brush and a cleaning brush cover. The cleaning brush is arranged in the housing, and the cleaning brush cover covers the housing. In addition, the cleaning brush cover is provided with a dust suction opening that allows the cleaning brush to contact the ground. The cleaning brush adsorbs dust for cleaning through the dust suction opening when rotating. However, it is difficult for traditional cleaning brushes to clean slender garbage such as hairs, especially short hairs on the ground, which are even more difficult to clean thoroughly.

Figure 9:
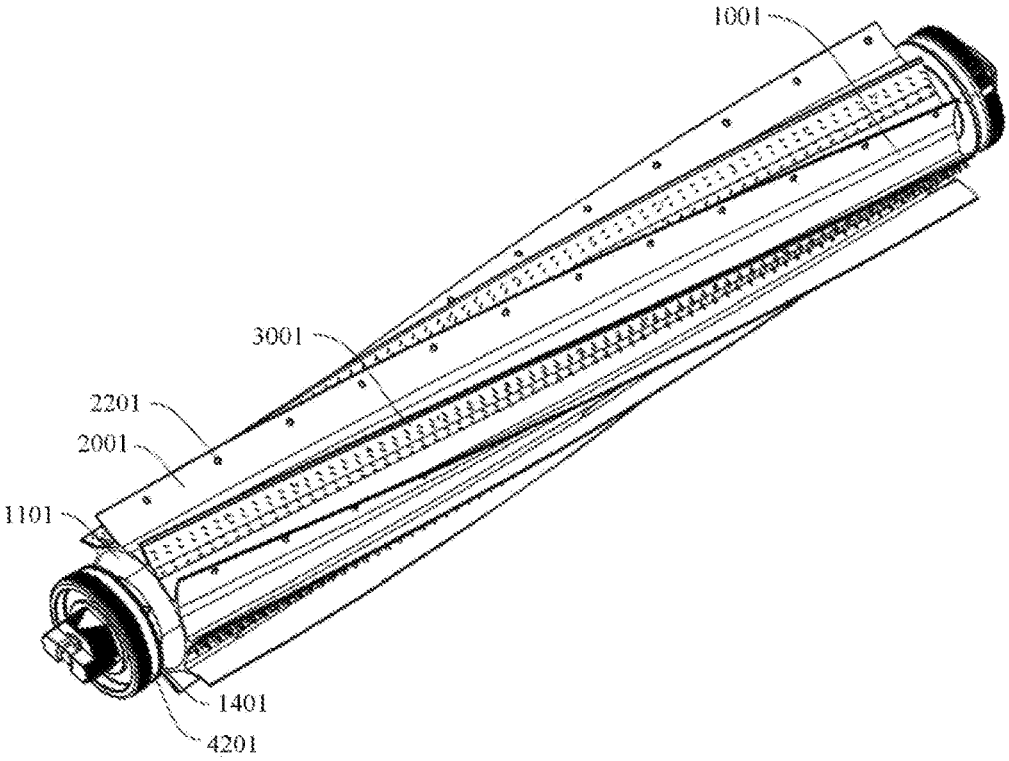
FIG. 9 is a schematic diagram of a cleaning brush according to an embodiment of the present disclosure.

In order to overcome the above problems, the present disclosure further provides a cleaning brush used to sweep garbage on the ground, such as dust or hairs, by means of rotation. Referring to FIG. 9, the cleaning brush includes a main brush body 1001, a plurality of blades 2001 and wool strips 3001. The main brush body 1001 is cylindrical and provided with a through hole 1201 inside. The plurality of blades 2001 are spirally fixed to the surface of the main brush body 1001 in an axial direction of the cleaning brush. One surface of each wool strip 3001 is provided with a plurality of bristles 3101, and the other surface of the wool strip 3001 is fixedly connected to a part of the blades 2001.

In actual use, the main brush body 1001 sweeps the ground by means of rotation. Specifically, referring to FIG. 10, the main brush body 1001 rotates along an arrow A. In the rotation process of the main brush body 1001, the blades 2001 are in contact with the ground, and sweep dust to the inside of a sweeping robot, and the dust is sucked away through the dust suction opening (not shown in the figure) of the sweeping robot.

In the sweeping process, slender garbage such as hairs will contact the blades 2001, and driven by the blades 2001 to rotate. However, in the rotation process of the main brush body 1001, the spiral blades 2001 can play a guide role to drive the garbage to slide to two ends of the main brush body 1001 along the blades 2001, in particular, two ends of the blades 2001, such that the cleaning brush guides this type of garbage to two ends of the main brush body 1001 for collection.

In the process of sweeping the ground, the wool strips 3001 on the blades 2001 can have the following two functions in the sweeping process:

1, the bristles 3101 are in direct contact with the garbage on the ground, and sweep up the garbage by cooperating with the blades 2001 as the main brush body 1001 rotates; and finally, the garbage is sucked away by the sweeping robot; and 2, the bristles 3101 rub against the ground to generate static electricity, and the bristles 3101 that generate the static electricity can adsorb garbage such as short hairs that are very light but have a certain length, so that the short hairs are adhered among the bristles 3101 and are finally sucked away by the sweeping robot.

The wool strips 3001 are combined to the blades 2001 on the cleaning brush. The plurality of bristles 3101 contact the ground and leave the short hairs on the wool strip 3001 while the cleaning brush rotates and sweeps the ground, till the short hairs are sucked away by the sweeping robot, thereby effectively cleaning up the short hairs on the ground and improving the sweeping quality.

In summary, according to the cleaning brush for a cleaning device in this embodiment of the present disclosure, the blades 2001 spirally distributed on the surface of the main brush body 1001 can guide slender-strip-shaped garbage such as hairs on the ground to travel to two ends of the main brush body 1001 while rotating and sweeping the ground, and at the same time cooperate with the wool strips 3001 on some of the blades 2001. The plurality of bristles 3101 on the wool strips 3001 rub against the ground to generate static electricity, and shorter hairs are adsorbed onto the bristles 3101 by means of the static electricity, such that hairs of all lengths on the ground can be effectively cleaned up, thereby improving the sweeping quality.

It should be mentioned that in the cleaning brush of this embodiment, the fixation of the blades to the surface of the cleaning brush in a spiral shape along the axial direction of the cleaning brush may be implemented by the following two ways:

1, the main brush body 1001 and the blades 2001 are integrally formed, i.e., formed by one-time processing by a mold in the production process by means of injection molding or other processes, and this embodiment can facilitate cost input reduction by a producer while reducing processes required for assembly, thereby improving the production efficiency; and 2, the main brush body 1001 and the blades 2001 are arranged separately, i.e., the main brush body 1001 and the blades 2001 are manufactured from different molds respectively in the production process; and upon the completion of processing, the plurality of blades 2001 are assembled to the main brush body 1001. The fixing mode includes, but is not limited to clamping and welding. By means of this embodiment, it is convenient for a user to replace damaged blades 2001 on the main brush body 1001.

Referring to FIG. 9, further, the blades 2001 extend from one end of the main brush body 1001 to the other end of the main brush body 1001 in order to better guide slender garbage such as hairs to travel to the two ends of the main brush body 1001 in use. In actual use, the plurality of blades 2001 alternately contacts the ground and sweeps the garbage as the main brush body 1001 rotates. The slender garbage such as hairs will slide along the blades 2001 on the main brush body 1001 to the two ends of the main brush body 1001 so as to be sucked away and cleaned up.

In other embodiments, the blades 2001 may also be discontinuous (not shown in the figure), that is, the blades 2001 on the main brush body 1001 do not extend from one end of the main brush body 1001 to the other end of the main brush body 1001. Instead, the blades 2001 on the main brush body 1001 may extend from the end of the main brush body 1001 to the middle of the main brush body 1001, and the two adjacent blades 2001 extend from two opposite ends and extend to the middle of the main brush body 1001. In this embodiment, slender garbage such as hairs can still slide to the two ends of the main brush body 1001 by contacting the spiral blades 2001 so as to achieve the purpose of sweeping all garbage on the ground.

Figure 10:
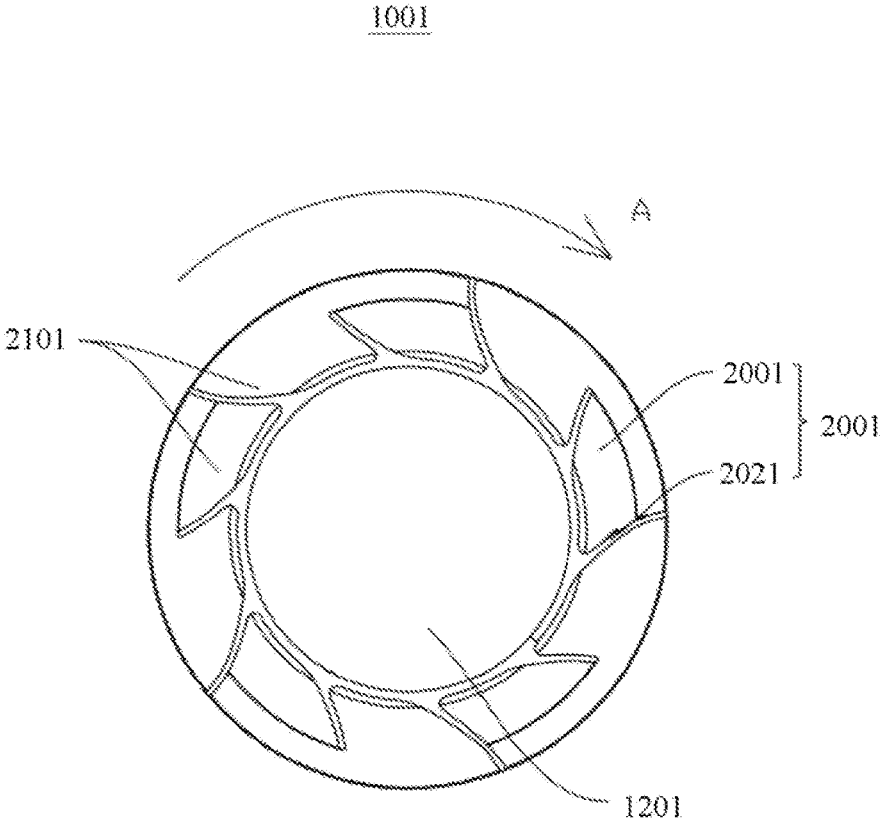
FIG. 10 is a schematic diagram of a main brush body of a cleaning brush according to an embodiment of the present disclosure.

In the sweeping process, as the main brush body 1001 rotates, specifically, referring to FIG. 10, rotates in the arrow A, one surface of each blade 2001 may contact the ground directly. It may be understood that this surface that contacts the ground directly is a sweeping surface 2101 of the blade 2001 for sweeping. The blade 2001 is inclined relative to the side away from the sweeping surface 2101 on a cross-section of the main brush body 1001.

Figure 13:
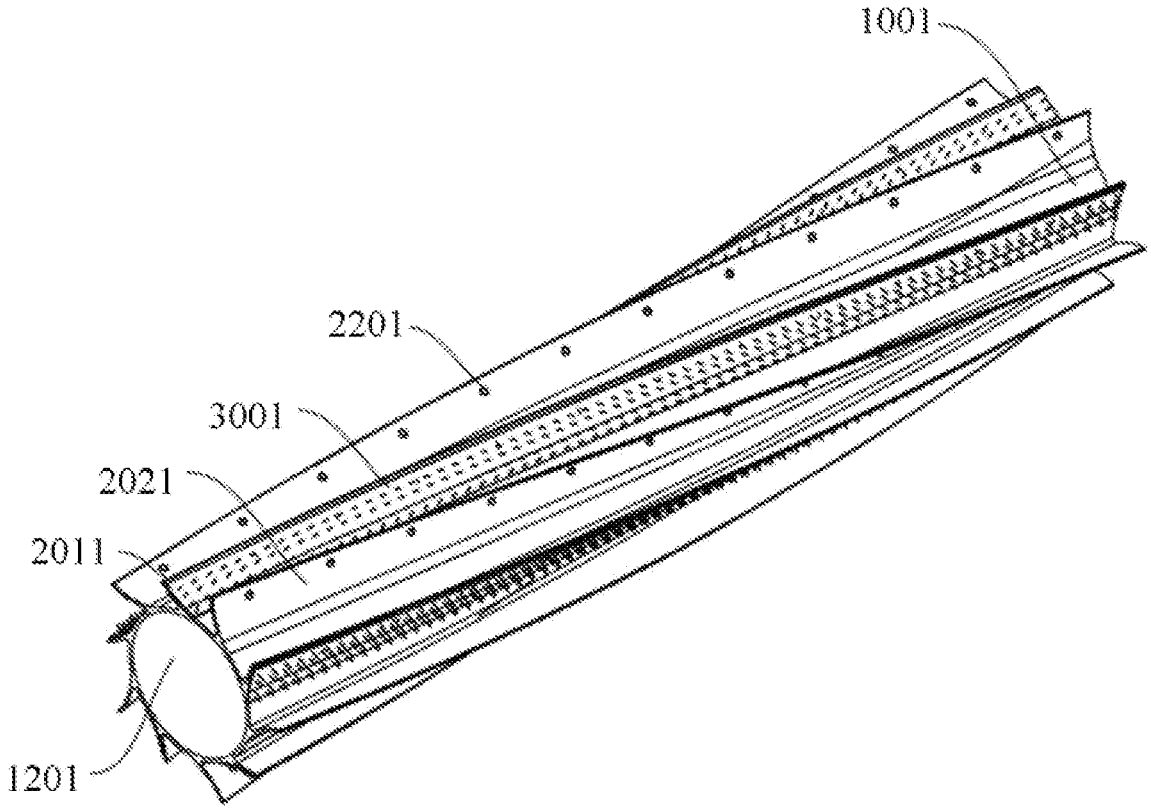
FIG. 13 is a schematic diagram of a combination of a main brush body, blades and bristles of a cleaning brush according to an embodiment of the present disclosure.

In actual use, the cleaning brush will rotate in a direction opposite to the inclination direction of the blades 2001. During the rotation process, the cleaning surface 2101 will directly contact the ground and take the garbage on the ground up. Dust and other fine garbage will be sucked into the sweeping robot in the rolling process of the main brush body 1001, while a part of hairs and other slender garbage cannot be sucked away to form residual garbage, which may move to the two ends of the blades 2001 along the blades 2001. Referring to FIG. 9 and FIG. 13, this garbage will move to the two ends of the main brush body 1001 for concentrated processing.

It should be mentioned that the inclined blades 2001 can better make the cleaning surface 2101 and the ground fully contact during the rotation of the main brush body 1001, and sweep dust, hairs and other garbage, thereby improving a sweeping effect.

It should be mentioned that the blades 2001 fixed spirally have a limited effect on guiding slender garbage such as hairs merely relying on its guiding role. In order to further improve the effect of sweeping slender garbage such as hairs, the sweeping surfaces 2101 of part of the blades 2001 are provided with a plurality of salient points 2201; and the sweeping surfaces of the other part of the blades 2001 are fixedly connected to the wool strips 3001.

On the sweeping surfaces 2101 provided with the salient points 2201, the plurality of the salient points 2201 is arranged in an extension direction of the blades 2001. The salient points 2201 are arranged such that the salient points 2201 can guide hairs and other slender garbage in the process that the hairs and other slender garbage move on the surfaces of the blades 2001. Specifically, the main brush body 1001 rotates to drive the plurality of blades 2001 to alternately contact the ground and sweep the garbage up, and the garbage will contact the salient points 2201 in the movement process while the hairs and other slender garbage are swept up.

Firstly, the salient points 2201 can block the garbage, preventing the garbage from falling out of the blades 2001 and re-scattering to the ground.

Secondly, the garbage is in direct contact with the salient points 2201 during the movement process, and the salient points 2201 can guide the garbage, thereby guiding the garbage to move along edges of the salient points 2201, and in cooperation with the spiral blades 2001, making the garbage move to the two ends of the main brush body 1001 for collection and cleaning up as the main brush body 1001 rotates.

It can be seen from the foregoing that the blades 2001 will directly contact and collide with the ground during rotation, and in the process of contact and collision with the ground, a lot of noise will be generated. Therefore, the blades 2001 includes first blades 2011 and second blades 2021, and on the cross-section of the main brush body 1001, the length of the first blade 2011 is less than the length of the second blade 2021. With this design, the noise generated by the cleaning brush while sweeping the ground is reduced, and the user experience is improved.

Specifically, in the sweeping process, hairs and other slender garbage will contact the first blades 2011 and the second blades 2021 first, and the first blades 2011 and the second blades 2021 drive the garbage to rotate. However, as the main brush body 1001 rotates, due to a length difference between the first blade 2011 and the second blade 2021, a contact amplitude between the first blade 2011 and the ground is different from a contact amplitude between the second blade 2021 and the ground, and the noise generated by the contact of the first blade with the ground is different from the noise generated by the contact of the second blade with the ground. Specifically, the shorter first blades 2011 will produce less noise when contacting the ground. By disposing the first blades 2011 and the second blades 2021, which are not fixed in length, on the surface of the main brush body 1001, the noise generated by the cleaning brush while sweeping the ground is reduced, thereby improving the user experience.

In addition, the main brush body 1001 will also bring vibration to the first blades 2011 and the second blades 2021 in the rotation process, and the vibration of the shorter first blades 2011 will generate less noise than the longer second blades 2021.

In contrast, a sweeping effect of the second blades 2021 will be better than that of the first blades 2011, so the cleaning effect will be sacrificed if the shorter blades 2001 are used in order to reduce noise. Therefore, the wool strips 3001 are merely fixedly connected to the first blades 2011, Thus, the cleaning effect on the ground can be ensured while the noise caused by the cleaning brush during the rotation process is reduced.

Further, the adjacent first blades 2011 and second blades 2021 are arranged equidistantly. The first blades 2011 and the second blades 2021, which are spaced apart from one another, are arranged equidistantly, and such an equidistant arrangement can stabilize the entire cleaning brush in the rotation process, and make the working process of the entire sweeping robot smoother, thereby improving the cleaning effect.

In addition, the stable working state can reduce the operating vibration of the entire sweeping robot to a minimum, thereby effectively reducing the noise generated by the sweeping robot in actual work.

The first blades 2011 collide with and contact the ground with the rotation of the main brush body 1001, and the first blades 2011 will be more easily damaged than the second blades 2021 in long-term use due to their smaller length. Therefore, further, the thickness of the first blade 2011 is greater than the thickness of the second blade 2021. By increasing the thickness of the first blade 2011, the strength of the first blade 2011 can be improved, thereby avoiding the first blade 2011 from being damaged in actual use. In addition, the increase in the thickness of the first blades 2011 can also reduce the vibration of the first blades 2011, thereby reducing the noise generated by the first blades 2011 during rotation.

Specifically, the thickness of the first blade 2011 may be twice the thickness of the second blade 2021. This implementation is only one embodiment of the cleaning brush of the present disclosure, and the remaining embodiments in which the thickness of the first blade 2011 is greater than the thickness of the second blade 2021 shall be deemed to be within the scope covered by the present disclosure.

Figure 11:
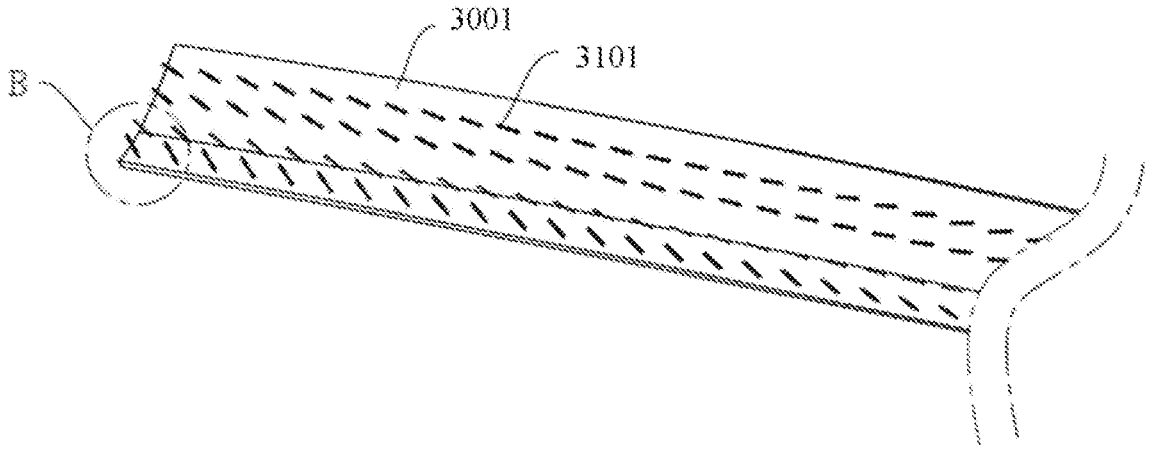
FIG. 11 is a schematic diagram of a wool strip of a cleaning brush according to an embodiment of the present disclosure.
Figure 12:
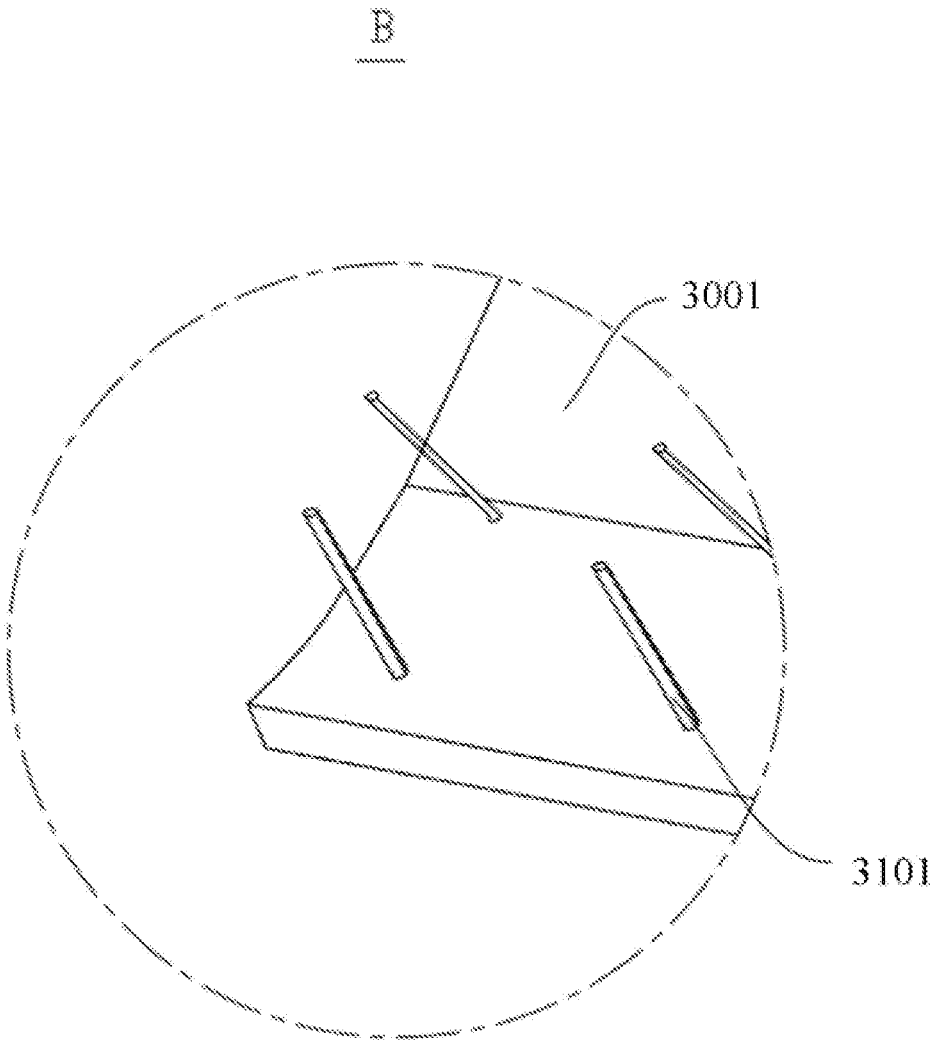
FIG. 12 is an enlarged view of a part B in FIG. 10.

It should be mentioned that, referring to FIGS. 11 and 12, the bristles 3101 are perpendicular to the surface of the corresponding wool strip 3001. Since the bristles 3101 are perpendicular to the surface of the corresponding wool strip 3001, the sweeping effect can be improved effectively. Specifically, the bristles 3101 are perpendicular to the surfaces of the blades 2001 since the bristles 3001 are fitly installed on the blades. When the blades 2001 are in contact with the ground and sweep the ground, all bristles 3101 are bent from an angle that the bristles are perpendicular to the ground to contact with the ground. Specifically, a part of garbage is swept up after the bristles 3101 contact with the ground. In addition, as the main brush body 1001 drives the blades 2001 to rotate, the bristles 3101 restore to the state in which the bristles are perpendicular to the blades 2001. The bristles 310 will be in sufficient contact with the ground in the restoration process and product static electricity, so as to adsorb short hairs on the ground, thereby improving the sweeping effect of the entire sweeping robot.

In order to improve the sweeping effect and achieve better efficient cleaning of the ground, further, a plurality of bristles 3101 is arranged on the surface of a cylinder in a matrix. The plurality of bristles 3101 can improve the sweeping effect, such that the ground can be swept by the plurality of bristles at the same time while the blades 2001 contact the ground. In addition, the plurality of bristles 3101 arranged in the matrix can more effectively make sweeping effects of various areas on the wool strip 3001 consistent. When the blades 2001 sweep the ground, each area on the whole blade 2001 can effectively clean the ground, thereby improving the sweeping effect.

In the above embodiments, it should be mentioned that the bristles 3101 include hard plastic. The bristles made of the hard plastic 3101 can better rub against the ground to generate static electricity, so as to more effectively adsorb short hairs on the ground to multiple brush hairs, thereby sweeping the ground.

Figure 15:
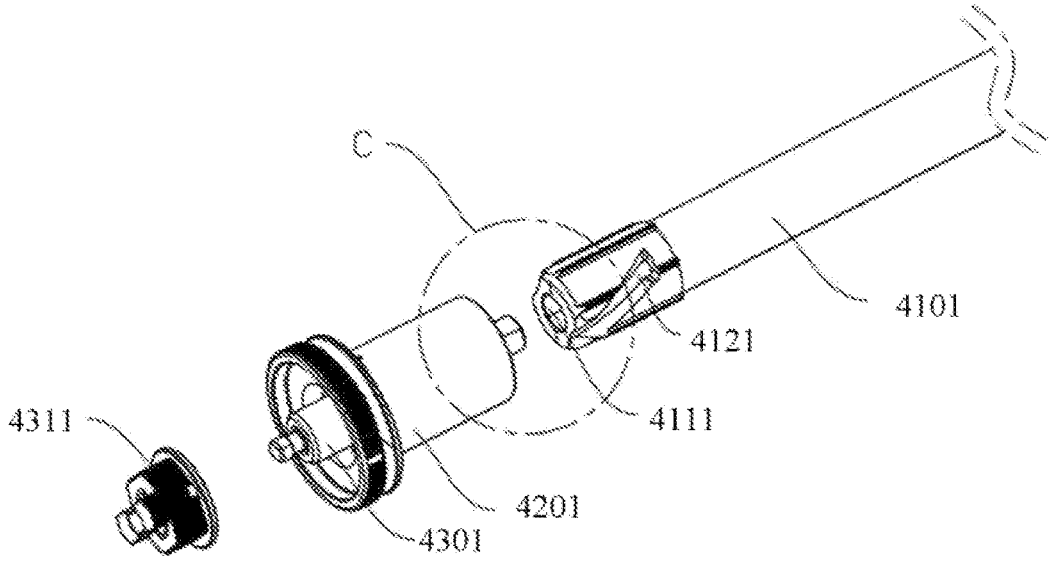
FIG. 15 is an exploded view of a main brush shaft of a cleaning brush according to an embodiment of the present disclosure.

Correspondingly, the sweeping robot is provided with a driving mechanism for driving the entire cleaning brush to rotate. In order to be connected with the driving mechanism, the cleaning brush also includes a main brush shaft 4001. Referring to FIG. 15, the main brush shaft 4001 includes a main shaft 4101 and end covers 4201. The end covers 4201 are detachably installed at two ends of the main shaft 4101 respectively. A through hole 1201 that axially penetrates the main brush body 1001 is formed in the main brush body 1001, and the main shaft 4101 is inserted into the through hole 1201. The driving mechanism is directly connected to the end covers 4201 of the main brush shaft 4001, thereby driving the entire main shaft 4101 to rotate through the end covers 4201, and then driving the cleaning brush to rotate and sweep the garbage on the ground. In daily use, if there is a structural failure of a connection structure between the driving mechanism and the main brush shaft 4001, the cleaning brush is directly removed from the sweeping robot, the end covers 4201 arranged at the two ends of the main shaft 4101 are removed and replaced, and then the cleaning brush can be re-installed to the sweeping robot for normal work.

Therefore, when the end cover 4201 of the main brush shaft connected to the driving mechanism 4201 has a failure, it is only necessary to disassemble the damaged end cover 4201 and replace it with another end cover 4201, instead of replacing the entire main brush shaft 4001, thereby achieving high convenience in use and reducing the user's use cost.

Figure 17:
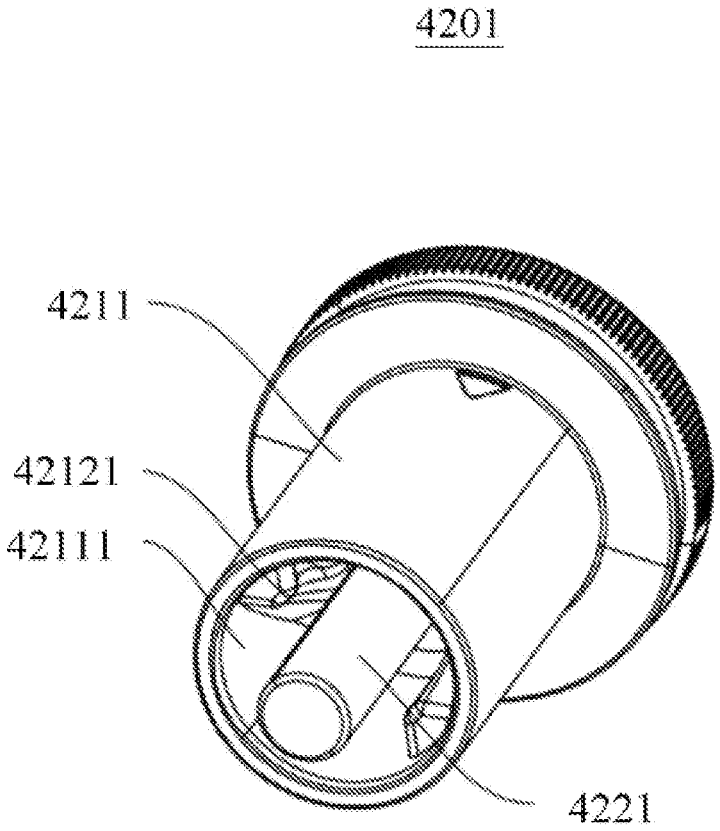
FIG. 17 is a schematic diagram of an end cover of a cleaning brush according to an embodiment of the present disclosure.

It should be mentioned that, referring to FIG. 17, each end cover 4201 includes a barrel body 42111 and a connecting shaft 4221. The barrel body 42111 is provided with an installing groove 42111 in which the main shaft 4101 is inserted; and the connecting shaft 4221 is inserted in the barrel body 4211 in an axial direction of the barrel body 4211. One end of the connecting shaft 4221 extends out of the barrel body 4211, and the other end of the connecting shaft 4221 is located in the installing groove 42111; and an end of the main shaft 4101 is provided with an insertion groove 4111 in which the connecting shaft 4221 is inserted.

The end cover 4201 directly sleeves the main shaft 4101 to realize the installation with the main shaft 4101. The installing groove 42111 of the end cover 4201 and the main shaft 4101 cooperate with each other and can constrain each other in position, so that relative positions of the end cover 4201 and the main shaft 4101 in a radial direction are unchanged. After the two end covers 4201 are installed at two ends of the main shaft 4101 respectively, the entire main brush shaft 4001 is installed in the overall structure of the sweeping robot, and connected to the driving mechanism, so as to output a torque through the driving mechanism and drive the main shaft 4101 to rotate; thereby driving the main brush body 1001 installed on the main shaft 4101 to rotate and sweeping the garbage on the ground by the main brush body 1001.

During the installation process, the barrel body 4211 of the end cover 4201 is used for installation and connection with the entire main shaft 4101, while one end of the connecting shaft 4221 inserted in the barrel body 4211 is connected to the main shaft 4101, and the other end of the connecting shaft 4221 is connected to the driving mechanism of the sweeping robot. It should be mentioned that one of the end covers 4201 at two ends is connected to the driving mechanism, and the other end cover is rotatably connected to the entire structure of the sweeping robot directly. In the actual use process, the torque is output through the driving mechanism; then the power is transmitted to the main shaft 4101 through the connecting shaft 4221, and the main brush body 1001 installed on the main shaft 4101 is driven further to rotate, such that the garbage on the ground is cleaned up through the main brush body 1001.

Figure 16:
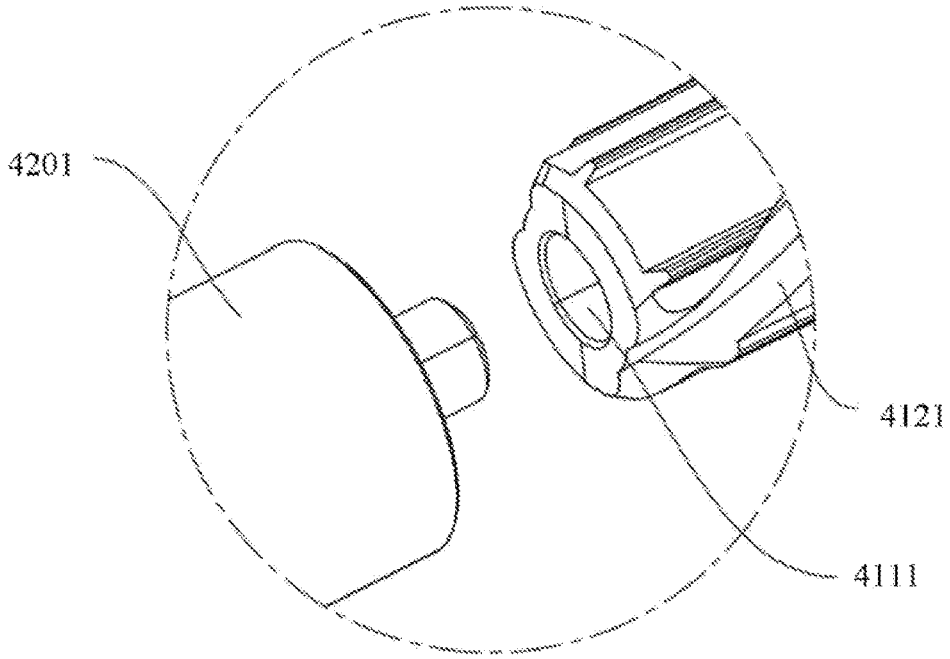
FIG. 16 is an enlarged view of a part C in FIG. 15.

Further, referring to FIG. 16 and FIG. 17, in the cleaning brush according to this embodiment of the present disclosure, an outer surface of an end of the main shaft 4101 is provided with a clamping groove 4121, an inner surface of the installing groove 42111 is provided with a protrusion 42121, and the protrusion 42121 cooperates with the clamping groove 4121 to constraint relative positions of the end cover 4201 and the main shaft 4101 in a radial direction. Due to the cooperation between the clamping groove 4121 and the protrusion 42121, the end cover 4201 cannot rotate relative to the main shaft 4101. In a case that the power is transmitted to the main shaft 4101 by rotating the shaft, the entire main brush shaft 4001 can rotate without structural slippage, thereby ensuring the smooth progress of the entire rotation process and ensuring the cleaning effect of the entire cleaning brush on the ground.

Moreover, referring to FIG. 16 and FIG. 17, the clamping groove 4121 extends from the end surface of the main shaft 4101 towards the center of the main shaft 4101 and is formed in the outer surface of the main shaft 4101. Therefore, in the assembly process, the end cover 4201 can be preliminarily constrained and positioned at the time of assembly, which is convenient for the user to install the main shaft 4101 and the end cover 4201, thereby improving the assembly efficiency.

Further, in order to make the assembled structure more stable to improve the working stability of the entire cleaning brush, referring to FIG. 16, the clamping groove 4121 in the main shaft 4101 spirally extends on the outer surface of the end of the main shaft 4101. Correspondingly, the protrusion 42121 has a shape matching that of the clamping groove 4121. In this embodiment, by forming the spiral clamping groove 4121 with a certain arc, the stability of a clamping structure formed after assembly of the protrusion 42121 and the clamping groove 4121 can be improved, thereby improving the structural stability and movement stability of the entire main brush shaft 4001 during the rotation.

Further, in order to be connected with the driving mechanism on the sweeping robot, referring to FIG. 15, one end of the connecting shaft 4221, which extends out of the barrel body 4211 is connected with a bearing 4301 which is sleeved with a bearing sleeve 4311. By means of the cooperation of the bearing sleeve 4311 and the driving mechanism, the entire main brush shaft 4001 is connected to the driving mechanism in the sweeping robot through the end cover 4201.

It should be mentioned that in the main brush shaft 4001 according to this embodiment of the present disclosure, the barrel body 4211, the connecting shaft 4221 and the main shaft 4101 are coaxially arranged. By means of the coaxial arrangement, after the end cover 4201 is connected to the driving mechanism, the main shaft 4101 rotates, without any biasing, thereby improving the rotation stability of the entire main brush shaft 4001 and improving the sweeping effect.

It should be mentioned that the above driving mechanism is generally driven by a motor, and other driving mechanisms for providing a driving force should also be regarded as the driving mechanism mentioned in the embodiments of the present disclosure.

Figure 14:
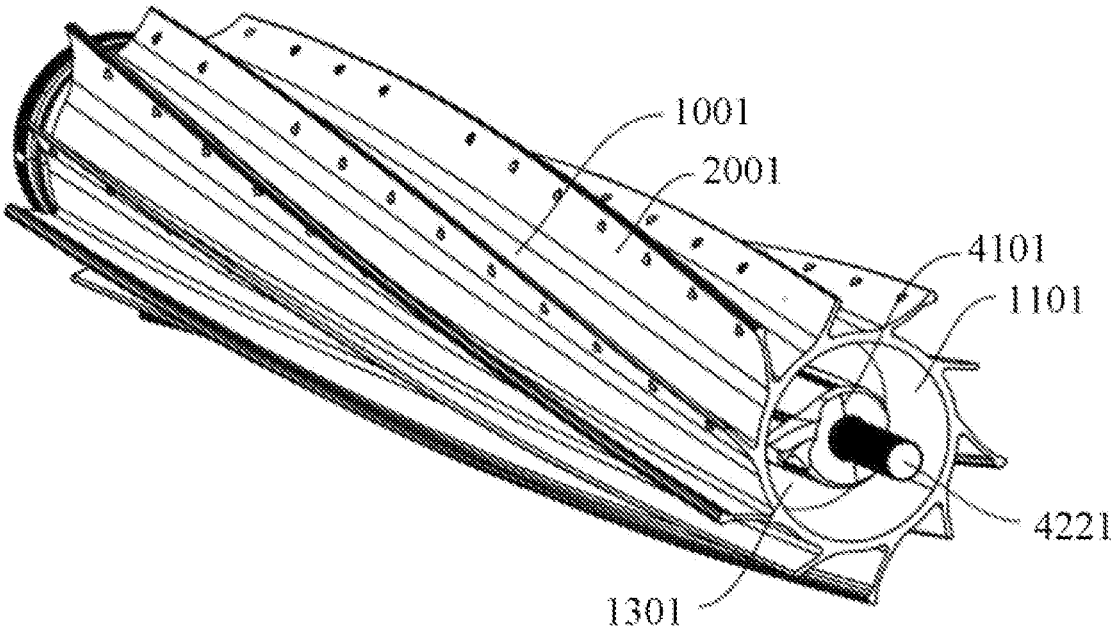
FIG. 14 is a schematic diagram of a cleaning brush (a barrel body is absent) according to an embodiment of the present disclosure.

Most of the garbage that travels to two ends of the main brush body 1001 will be sucked away and cleaned up, but there will be some that cannot be cleaned up in time. In order to prevent part of the garbage that has not been cleaned up punctually from falling back into the environment, an axial length of the sleeve 1301 is less than an axial length of the main brush body 1001, so that clearance grooves 1101 are constructed at two ends of the main brush body 1001. Referring to FIG. 14, after hair and other slender garbage travel along the blades 2001 on the main brush body 1001 to the two ends of the main brush body 1001, part of the garbage will be sucked away, and the remaining garbage will be stored in the clearance grooves 1101. Upon the completion of sweeping, the user can pour the garbage in the clearance grooves 1101 out and carry out centralized treatment. The garbage that has not been cleaned punctually can be stored by providing the clearance grooves 1101 to prevent the garbage from falling back to the ground, thereby improving the sweeping effect.

Further, a gap 1401 is formed between the corresponding end cover 4201 and each of end surfaces of the two ends of the main brush body 1001. In order to avoid the situation that the garbage cannot enter the clearance grooves 1101 at the two ends of the main brush body 1001, referring to MG. 9, in a further improvement of the above embodiment, the gap 1401 is formed between the corresponding end cover 4201 and each of end surfaces of the two ends of the main brush body 1001. The gap 1401 between the end cover 4201 and the main brush body 1001 can provide a space for the garbage to be introduced. Specifically, in a case that the garbage on the blades 2001 travels to the two ends of the main brush body 1001 in an extension direction of the blades 2001, Part of the garbage that has not been sucked away will be introduced into the clearance grooves 1101 through the gap 1401 for storage under the action of a suction force, so as to facilitate the centralized treatment of this part of garbage after sweeping.

Specifically, the gap 1401 means that the end cover 3001 and the main brush body 1001 will not abut against each other after the end cover 3001 is assembled to the cleaning brush, but there is a distance between the end cover 3001 and the end of the main brush body 1001, and a space formed by this distance is the above-mentioned gap 1401.

It should be mentioned that the end covers 4201 are detachably installed at two ends of the main brush body 1001. The convenience of cleaning can be further improved. After cleaning, the end covers 4201 are disassembled directly, all the garbage in the clearance grooves 1101 can be poured out, and the end covers are then re-assembled.

In summary, the present invention provides a cleaning brush. The cleaning brush includes a shaft rod, a cylindrical member and at least one end member. The shaft rod is provided with two first ends opposite in an axial direction; the cylindrical member coaxially sleeving the shaft rod and is provided with two second ends opposite in an axial direction, and a brush piece is arranged on an outer surface of the cylindrical member; the at least one end member is installed on at least one of the first ends; and the end member is provided with a blocking structure used for preventing an entanglement from excessively extending away from the cleaning brush; the end member and the first end are provided with installation structures matching each other respectively; and the second end of the cylindrical member, which corresponds to the end member, covers at least a portion of the end member.

According to one implementation of the present disclosure, the second end of the cylindrical member, which corresponds to the end member, covers the first end on which the end member is installed.

According to one implementation of the present disclosure, the blocking structure of the end member is located outside the second end of the cylindrical member, which corresponds to the end member.

According to one implementation of the present disclosure, the installation structure includes a guide hole and a guide shaft. A guide hole is coaxially formed in an end surface of the first end; and the guide shaft is connected to the end member and used for being inserted into the guide hole.

According to one implementation of the present disclosure, the installation structure includes a guide sleeve. The guide sleeve is arranged at an end of the end member facing the shaft rod and used for sleeving the first end; a sidewall of the first end is provided with at least one first limiting structure; and an inner wall of the guide sleeve is provided with at least one second limiting structure matching the at least one first limiting structure.

According to one implementation of the present disclosure, a distance between the blocking structure and an end of the guide sleeve away from the end member is greater than 5% of a length of the shaft rod along the axial direction of the shaft rod, and the blocking structure and the guide sleeve correspond to a same first end.

According one implementation of the present disclosure, one of the first limiting structure and the second limiting structure is a limiting rib, and the other is a limiting groove, the limiting rib matching the limiting groove in shape.

According to one implementation of the present disclosure; the limiting rib and the limiting groove are in spiral shapes matching each other.

According to one implementation of the present disclosure, a spiral direction of the spiral limiting rib and the spiral limiting groove is opposite to a rotation direction of the shaft rod.

According to one implementation of the present disclosure, an outer wall of the guide sleeve is provided with at least one first assembly identifier used for marking a rotation direction of the end member while being assembled with the shaft rod.

According to one implementation of the present disclosure, the second limiting structure is the limiting rib, the limiting rib being arranged on the inner wall of the guide sleeve by welding or an integrated molding process, or being formed from a part of structure of the guide sleeve through a stamping process; or the second limiting structure is the limiting groove, the limiting groove being a groove formed in the inner wall of the guide sleeve, or being a through groove penetrating through the guide sleeve.

According to one implementation of the present disclosure, the first end is provided with a plurality of the first limiting structures, which is uniformly arranged at intervals in a circumferential direction of the shaft rod.

According to one implementation of the present disclosure, the guide sleeve is provided with a plurality of the second limiting structures, which is uniformly arranged at intervals in a circumferential direction of the guide sleeve.

According to one implementation of the present disclosure, the outer wall of the outer wall of the guide sleeve is provided with at least one second assembly identifier, the at least one second assembly identifier corresponding to the at least one second limiting structure in position and used for marking a position of the at least one second limiting structure.

According to one implementation of the present disclosure, the blocking structure is a blocking ring, the blocking ring surrounding the outer circumference of the end member and being a closed-loop structure.

According to one implementation of the present disclosure, the end member is installed one each of the two first ends of the shaft rod, one of the two end members is provided with a transmission structure, and the other is used for installation of a bearing structure.

According to one implementation of the present disclosure, the transmission structure includes a columnar structure with a regularly polygonal cross-section, an axis of the columnar structure coinciding with an axis of the end member and an axis of the shaft rod; and the transmission structure is used to cooperate with an output end of a driving mechanism.

According to one implementation of the present disclosure, an end of the guide shaft of the end member, which is away from the shaft rod, extends out of the end member and serves as a matching section matching the bearing structure; and the bearing structure is detachably arranged on the matching section of the guide shaft.

According to one implementation of the present disclosure, the matching section is provided with a positioning groove in a circumferential direction, the positioning groove cooperating with the bearing structure by fixing each other's positions to prevent the bearing structure from displacing.

According to one implementation of the present disclosure, the cylindrical member is a flexible member or a rigid member.

The present disclosure further provides an intelligent cleaning device, which includes the cleaning brush proposed in the present disclosure and described in the above implementations.

From the above technical solutions, it can be seen that the cleaning brush and the intelligent cleaning device proposed in the present disclosure have the following advantages and positive effects.

The cleaning brush provided by the present disclosure includes the shaft rod, the cylindrical member and the end member. The end member is installed on the first end. The end member is provided with the blocking structure used for preventing an entanglement from excessively extending away from the cleaning brush. The end member and the first end are provided with installation structures matching each other respectively. The second end of the cylindrical member, which corresponds to the end member, covers at least a portion of the end member. With the above design, in the present disclosure, at least a portion of the end member intervenes between the shaft rod and the corresponding end of the cylindrical member, avoiding an entanglement wound on the cylindrical member from being wound to the shaft, rod directly. Instead, the entanglement is wound on the end member and can thus be removed with the disassembly of the end member, such that cleaning is more convenient.

The present disclosure further provides a cleaning brush. The cleaning brush includes a main brush body, a plurality of blades and a wool strip, wherein the main brush body is cylindrical and provided with a through hole inside. The plurality of blades are spirally fixed to the surface of the main brush body in an axial direction of the cleaning brush. One surface of the wool strip is provided with a plurality of bristles, and the other surface of the wool strip is fixedly connected to a part of the blades.

According to one implementation of the present disclosure, each blade has a sweeping surface for sweeping; and on a cross-section of the main brush body, one side of the blade away from the sweeping surface is inclined.

According to one implementation of the present disclosure, the sweeping surfaces of a part of the blades are provided with a plurality of salient points; and the sweeping surfaces of the remaining part of the blades are fixedly connected to the wool strip.

According to one implementation of the present disclosure, the bristles are perpendicular to the surface of the wool strip.

According to one implementation of the present disclosure, the blades include first blades and second blades, wherein the length of each first blade is less than the length of each second blade on the cross-section of the main brush body.

According to one implementation of the present disclosure, the wool strip is fixedly connected to the first blades merely.

According to one implementation of the present disclosure, the cleaning brush further includes a main brush shaft, the main brush shaft including a main shaft and end covers, wherein the end covers are detachably installed on two ends of the main shaft respectively; a through hole that axially penetrates the main brush body is formed inside the main brush body; and the main shaft is inserted into the through hole.

According to one implementation of the present disclosure, the main shaft is sleeved with a sleeve; the sleeve is sleeved with the main brush body; and an axial length of the sleeve is less than an axial direction of the main brush body, so as to form clearance grooves at two ends of the main brush body.

According to one implementation of the present disclosure, a gap is formed between the corresponding end cover and the end surface of each of two ends of the main brush body.

According to one implementation of the present disclosure, each end cover includes a barrel body and a connecting shaft, wherein the barrel body is provided with an installing groove in which the main shaft is inserted; the connecting shaft is inserted in the barrel body in an axial direction of the barrel body; one end of the connecting shaft extends out of the barrel body, and the other end of the connecting shaft is located in the installing groove; and an end of the main shaft is provided with an insertion groove in which the main shaft is inserted.

With the above design, the blades spirally distributed on the surface of the main brush body can guide slender-strip-shaped garbage such as hairs on the ground to swim to two ends of the main brush body while rotating and sweeping the ground, and at the same time cooperate with the wool strips on some of the blades. The plurality of bristles on the wool strip rub against the ground to generate static electricity, and shorter hairs are adsorbed on the bristles by means of the static electricity, such that hairs of all lengths on the ground can be effectively cleaned, thereby improving the sweeping quality.

The exemplary implementations of the cleaning brush and the intelligent cleaning device proposed in the present disclosure are described and/or illustrated above in detail. However, the implementations of the present disclosure are not limited to the particular implementations described herein. On the contrary, components and/or steps of each implementation may be used independently and separately from the other components and/or steps described herein. Each component and/or each step in one implementation may also be used in conjunction with other components and/or steps of other implementations. In the course of introducing the elements/components/etc. described and/or illustrated herein, the terms "a/an", "one" and "the" are used to indicate the presence of one or more elements/components/etc. The terms "comprising", "including" and "provided with" are used to denote open-ended inclusion and means that additional elements/components/etc. may exist in addition to those listed. In addition, the terms "first" and "second" in the claims and description are used only as marks and are not numerical restrictions on their objects.

Although the cleaning brush and the intelligent cleaning device proposed in the present disclosure have been described according to different particular embodiments, a person skilled in the art will recognize that the implementation of the present disclosure may be modified within the spirit and scope of the claims.

What is claimed is:

1. A cleaning brush, comprising:

a shaft rod, provided with two first ends opposite in an axial direction;

a cylindrical member, coaxially sleeving the shaft rod and provided with two second ends opposite in the axial direction, a brush piece being arranged on an outer surface of the cylindrical member; and at least one end member, installed on at least one of the first ends, the end member being provided with a blocking structure, the blocking structure being configured to prevent an entanglement from excessively extending away from the cleaning brush, the end member and the first end being provided with installation structures matching each other respectively, wherein the second end corresponding to the end member covers at least a portion of the end member;

wherein the installation structure comprises:

a guide sleeve, arranged at an end of the end member facing the shaft rod and configured to sleeve the first end, wherein a sidewall of the first end is provided with at least one first limiting structure, and an inner wall of the guide sleeve is provided with at least one second limiting structure matching the at least one first limiting structure;

wherein one of the first limiting structure and the second limiting structure is a limiting rib, and the other one of the first limiting structure and the second limiting structure is a limiting groove, the limiting rib matches the limiting groove in shape;

wherein the limiting rib and the limiting groove are in spiral shapes and match each other in shape.

2. The cleaning brush according to claim 1, wherein the second end corresponding to the end member covers the first end installed with the end member; or the blocking structure is located outside the second end corresponding to the end member; or the second end corresponding to the end member covers the first end installed with the end member; and the blocking structure is located outside the second end corresponding to the end member.

3. The cleaning brush according to claim 1, wherein the installation structure comprises:

a guide hole, coaxially defined in an end surface of the first end; and a guide shaft, connected to the end member and configured to be inserted into the guide hole.

4. The cleaning brush according to claim 1, wherein a distance between the blocking structure and an end of the guide sleeve away from the end member is greater than 5% of a length of the shaft rod along the axial direction of the shaft rod, and the blocking structure and the guide sleeve correspond to a same first end.

5. The cleaning brush according to claim 1, wherein spiral directions of the limiting rib and the limiting groove are opposite to a rotation direction of the shaft rod; or an outer wall of the guide sleeve is provided with at least one first assembly identifier configured to mark a rotation direction of the end member when the end member and the shaft rod are assembled; or spiral directions of the limiting rib and the limiting groove are opposite to a rotation direction of the shaft rod; and an outer wall of the guide sleeve is provided with at least one first assembly identifier configured to mark a rotation direction of the end member when the end member and the shaft rod are assembled.

6. The cleaning brush according to claim 1, wherein the second limiting structure is the limiting rib, the limiting rib being arranged on the inner wall of the guide sleeve by welding or an integrated molding process, or being formed from a part of structure of the guide sleeve through a stamping process; or the second limiting structure is the limiting groove, the limiting groove being a groove defined in the inner wall of the guide sleeve, or being a through groove penetrating through the guide sleeve.

7. The cleaning brush according to claim 1, wherein the first end is provided with a plurality of the first limiting structures uniformly arranged at intervals in a circumferential direction of the shaft rod; or the guide sleeve is provided with a plurality of the second limiting structures uniformly arranged at intervals in a circumferential direction of the guide sleeve; or the first end is provided with a plurality of the first limiting structures uniformly arranged at intervals in a circumferential direction of the shaft rod; and the guide sleeve is provided with a plurality of the second limiting structures uniformly arranged at intervals in a circumferential direction of the guide sleeve.

8. The cleaning brush according to claim 1, wherein an outer wall of the guide sleeve is provided with at least one second assembly identifier, the at least one second assembly identifier corresponds to the at least one second limiting structure in position and is configured to mark a position of the at least one second limiting structure.

9. The cleaning brush according to claim 1, wherein the blocking structure is a blocking ring surrounding an outer circumference of the end member and being a closed-loop structure.

10. The cleaning brush according to claim 1, wherein the end member is installed on each of the two first ends of the shaft rod, one of the two end members is provided with a transmission structure, and the other one of the two end members is configured for installation of a bearing structure.

11. The cleaning brush according to claim 10, wherein the transmission structure comprises a columnar structure with a regularly polygonal cross-section, an axis of the columnar structure coincides with an axis of the end member and an axis of the shaft rod, and the transmission structure is configured to cooperate with an output end of a driving mechanism.

12. The cleaning brush according to claim 10, wherein the installation structure comprises a guide hole and a guide shaft, the guide hole is coaxially defined in an end surface of the first end, the guide shaft is connected to the end member and is configured to be inserted into the guide hole, wherein an end of the guide shaft, of one of the end members, away from the shaft rod, extends out of the end member and serves as a matching section matching the bearing structure; and the bearing structure is detachably arranged on the matching section.

13. The cleaning brush according to claim 12, wherein the matching section is provided with a positioning groove in a circumferential direction, the positioning groove and the bearing structure form a positioning engagement to prevent the bearing structure from displacing.

14. An intelligent cleaning device, comprising a cleaning brush, the cleaning brush comprising:

a shaft rod, provided with two first ends opposite in an axial direction;

a cylindrical member, coaxially sleeving the shaft rod and provided with two second ends opposite in an axial direction, a brush piece being arranged on an outer surface of the cylindrical member; and at least one end member, installed on at least one of the first ends, the end member being provided with a blocking structure, the blocking structure being configured to prevent an entanglement from excessively extending away from the cleaning brush, the end member and the first end being provided with installation structures matching each other respectively, wherein the second end corresponding to the end member, covers at least a portion of the end member;

wherein the installation structure comprises:

a guide sleeve, arranged at an end of the end member facing the shaft rod and configured to sleeve the first end, wherein a sidewall of the first end is provided with at least one first limiting structure, and an inner wall of the guide sleeve is provided with at least one second limiting structure matching the at least one first limiting structure;

wherein one of the first limiting structure and the second limiting structure is a limiting rib, and the other one of the first limiting structure and the second limiting structure is a limiting groove, the limiting rib matches the limiting groove in shape;

wherein the limiting rib and the limiting groove are in spiral shapes and match each other in shape.

15. The intelligent cleaning device according to claim 14, wherein the second end corresponding to the end member covers the first end installed with the end member; or the blocking structure is located outside the second end corresponding to the end member; or the second end corresponding to the end member covers the first end installed with the end member; and the blocking structure is located outside the second end corresponding to the end member.

16. The intelligent cleaning device according to claim 14, wherein the installation structure comprises:

a guide hole, coaxially defined in an end surface of the first end; and a guide shaft, connected to the end member and configured to be inserted into the guide hole.

* * * * *